US008714709B2

(12) United States Patent
Yanata et al.

(10) Patent No.: US 8,714,709 B2
(45) Date of Patent: May 6, 2014

(54) INKJET PRINTHEAD

(75) Inventors: Atsuro Yanata, Tokyo (JP); Nobuko Yanata, legal representative, Kanagawa (JP); Yuichi Machida, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 13/806,277

(22) PCT Filed: Jun. 10, 2011

(86) PCT No.: PCT/JP2011/063329
§ 371 (c)(1),
(2), (4) Date: Dec. 21, 2012

(87) PCT Pub. No.: WO2012/002132
PCT Pub. Date: Jan. 5, 2012

(65) Prior Publication Data

US 2013/0120504 A1 May 16, 2013

(30) Foreign Application Priority Data

Jul. 2, 2010 (JP) ..... 2010-151602

(51) Int. Cl.
*B41J 2/14* (2006.01)

(52) U.S. Cl.
USPC ..... 347/50; 347/68; 347/71

(58) Field of Classification Search
USPC ..... 347/68–72, 50
See application file for complete search history.

(56) References Cited

U.S. PATENT DOCUMENTS

2007/0063206 A1* 3/2007 Maeda ..... 257/88

FOREIGN PATENT DOCUMENTS

| | | |
|---|---|---|
| JP | 2006-088676 | 4/2006 |
| JP | 2007-030361 | 2/2007 |
| JP | 2007-076327 | 3/2007 |

OTHER PUBLICATIONS

International Preliminary Report on Patentability and Written Opinion in English and Japanese.

* cited by examiner

*Primary Examiner* — Henok Legesse
(74) *Attorney, Agent, or Firm* — Lucas & Mercanti, LLP

(57) ABSTRACT

An inkjet head (3) comprises a wiring board (80) which. has, two-dimensionally arranged thereon, sets of nozzles (11) , pressure chambers (41) , and actuators (60) and which also has lines of wiring (87, 91) through-vias (85) , and ink flow paths (88); and connection sections (110, 111) which connect the lines of wiring to a drive section, the connection sections (110, 111) being disposed outside the arrangement region (R) in which the sets of the nozzles, the pressure chambers, and the actuators are arranged two-dimensionally. The nozzles are arranged in N rows (N is an integer greater than or equal to 2) , with each of the N rows comprising M nozzles (M is an integer greater than or equal to 2) which are arranged rectilinearly. The through-vias which correspond. to the nozzles of arbitrary n nozzle rows of the N nozzle rows (1≤n<N) are provided in the arrangement region, and the through-vias which correspond to the nozzles of the nozzle rows other than the arbitrary n nozzle rows are disposed outside the arrangement region. Thus, the simple configuration enables the space of the wiring board to be effectively utilized to reduce cost, enables the nozzles to be more densely arranged, and can improve the reliability of the lines of wiring.

8 Claims, 19 Drawing Sheets

FIG.12

| | | | | | | | | SPACE ALLOWED FOR ONE WIRE [μ m] | | | | | |
|---|---|---|---|---|---|---|---|---|---|---|---|---|---|
| NOZZLE DENSITY [npi] | NUMBER OF NOZZLE ROWS | PER ROW [npi] | SPACE BETWEEN NOZZLES [mm] | INSIDE DIAMETER OF INK CHANNEL [μ m] | OUTSIDE DIAMETER OF INK CHANNEL [μ m] | SPACE FOR WIRES ON UPPER SURFACE [mm] | SPACE FOR WIRES ON LOWER SURFACE [mm] | PATTERN A UPPER SURFACE | PATTERN B UPPER SURFACE | PATTERN C UPPER SURFACE | PATTERN C LOWER SURFACE | PATTERN D UPPER SURFACE | PATTERN D LOWER SURFACE |
| 600 | 16 | 37.5 | 0.677 | 100 | 200 | 0.577 | 0.477 | 36.1 | 72.2 | 144.3 | 119.3 | 115.5 | 159.1 |
| 600 | 8 | 75 | 0.339 | 100 | 200 | 0.239 | 0.139 | 29.8 | 59.7 | 119.3 | 69.3 | 79.7 | 139.0 |
| 600 | 32 | 18.75 | 1.355 | 100 | 200 | 1.255 | 1.155 | 39.2 | 78.4 | 156.8 | 144.3 | 125.5 | 192.5 |
| 1200 | 16 | 75 | 0.339 | 100 | 200 | 0.239 | 0.139 | 14.9 | 29.8 | 59.7 | 34.7 | 47.7 | 46.2 |
| 1200 | 32 | 37.5 | 0.677 | 100 | 200 | 0.577 | 0.477 | 18 | 36.1 | 72.2 | 59.7 | 57.7 | 79.5 |

INKJET PRINTHEAD

CROSS REFERENCE TO RELATED APPLICATION

This Application is a 371 of PCT/JP2011/063329 filed on Jun. 10, 2011 which, in turn, claimed the priority of Japanese Patent Application No. JP2010-151602 filed on Jul. 2, 2010, both Applications are incorporated by reference herein.

TECHNICAL FIELD

The present invention relates to an inkjet printhead included in an inkjet recording apparatus.

BACKGROUND ART

There has been known inkjet recording apparatuses to record a desired image on a recording medium by ejecting ink drops through nozzles of an inkjet printhead. Such inkjet recording apparatuses are used for various purposes, and various kinds of ink and recording mediums can be used in accordance with the purposes.

Examples of inkjet printheads include piezoelectric printheads which apply pressure to the ink in pressure chambers utilizing the displacement of piezoelectric elements to eject ink drops through nozzles communicating with the respective pressure chambers.

Among such piezoelectric printheads, there is a printhead that has densely-arranged nozzles to form a high-definition image. For example, there has been known a piezoelectric printhead-which has nozzles each communicating with a corresponding pressure chamber, with the sets of a nozzle and its corresponding pressure chamber arrayed two-dimensionally (see Patent Literature 1, for example).

FIG. 13A shows a circuit board 200 of an inkjet printhead viewed from above supposing that a head board 210 provided below the circuit board 200 can be seen through from above. FIG. 13B is a view of the lower surface, viewed from above, of the circuit board 200 of the inkjet printhead supposing that the lower surface and the head board 210 can be seen through from above. Both of FIG. 13A and FIG. 13B are drawn supposing that pressure chambers 202 (described later) provided in the head board 210 below the circuit board 200 can be seen through from above.

FIG. 14 is a cross-sectional view of the circuit board 200 and head board 210 of the inkjet printhead.

As shown in FIG. 13A, the head board 210 of the inkjet printhead is provided with a plurality of nozzles 201. The pressure chambers 202, ink channels 203, and piezoelectric elements 204 (see FIG. 14) are provided corresponding to the respective nozzles 201. The circuit board 200 is provided above the piezoelectric elements 204, which circuit board 200 is provided with wires 205 to be connected to the respective piezoelectric elements 204. Each of the wires 205 is led to the upper surface of the circuit board 200 through a through hole via 206.

Each of the wires 205 is connected to a wire-connection member 207 provided outside of the area where the nozzles 201 and pressure chambers 202 are arrayed two-dimensionally. The wires 205 corresponding to the respective nozzles are each connected to the wire-connection member 207 avoiding the ink channels 203.

When the wire-connection member 207 is provided on both sides of the area where the nozzles 201 are arrayed two-dimensionally as shown in FIG. 13A and FIG. 13B, N/2 wires of each line have to run between adjacent ink channels (i.e., between A and B in FIG. 13A and FIG. 13B).

When the number of nozzles in one line is N, for example, the number of piezoelectric elements provided corresponding to the respective nozzles is also N. When the wires are led toward the right and left sides (upper and lower sides of each of FIG. 13A and FIG. 13B), the number of wires disposed between adjacent ink channels of the $1^{st}$ nozzle row (i.e., between A and B in FIG. 13A and FIG. 13B) is N/2, where the density of wires is the highest on the left side. As the nozzle row moves on to the $2^{nd}$ row, $3^{rd}$ row . . . , the number of wires running between adjacent ink channels decreases one by one.

Dividing wires in half in such a way allows more space for wires compared to the case where all the wires corresponding the respective nozzles of each line are led toward the same direction. In order to achieve a printhead having densely-arranged nozzles, however, the printhead cannot provide enough space even if such a method is employed.

PRIOR ART LITERATURES

Patent Literatures

Patent Literature 1: Japanese Patent Publication Laid-Open No. 2007-30361

DISCLOSURE OF INVENTION

Problems to be Solved by the Invention

By the way, in order to enhance the reliability of wires, it is desired to make the space between wires large enough. When the space between wires is made larger, however, it is difficult to increase the density of nozzles. That is, the wires have to run between adjacent ink channels as described above, and therefore, when nozzles are densely arranged, the space between adjacent ink channels has to be small, resulting in reduction in space for wires.

In order to solve such problems, a multilayered circuit board composed of laminated multiple layers of circuit boards may be employed. Such a multilayered circuit board, however, is complex in structure and causes an inkjet printhead to become thicker. This makes it difficult to achieve weight saving and cost reduction.

Alternatively, the wires may be divided and arranged on both surfaces of a circuit board as disclosed in Patent Literature 1 (see FIG. 9). In this case, drive circuit is provided on each surface, and the wires arranged on each surface are connected to the drive circuit on the same surface. Providing a drive circuit on each surface of the circuit board, however, makes the manufacture of an inkjet printhead difficult, and causes the inkjet printhead to become thicker. This makes it difficult to achieve weight saving and cost reduction.

The present invention is made to solve the problems mentioned above, and aims to provide an inkjet printhead that achieves effective use of space on the circuit board and cost reduction, allows nozzles to be more densely arranged, and enhances the reliability of wires with a simple structure.

Means for Solving Problems

The invention of item 1 recites an inkjet printhead including: a plurality of sets each of which includes a nozzle to eject ink, a pressure chamber communicating with the nozzle, and an actuator to apply force to eject the ink in the pressure chamber through the nozzle, wherein the sets are two-dimensionally arrayed; a circuit board including: a wire connected to the actuator; a through hole via connected to the wire; and an ink channel to supply the ink to the pressure chamber; and a connection member to connect the wire to a driving unit, the connection member being provided outside of an array area, the array area being an area where the sets are two-dimensionally arrayed, wherein the nozzles are arranged linearly to form nozzle rows, and the number of the nozzles in each of the nozzle rows is M, wherein N is an integer of 2 or more; wherein the number of the nozzle rows is N, wherein N is an integer of 2 or more; wherein the through hole vias corresponding to the respective nozzles of n nozzle row of the N nozzle rows are provided inside of the array area, wherein n is any integer satisfying $1 \leq n < N$; and wherein the through hole vias corresponding to the respective nozzles of the N nozzle rows except the n nozzle row are provided outside of the array area.

The invention of item 2 recites the inklet printhead according to item 1, wherein N is an even number of 2 or more; wherein the wires connected to the through hole vias corresponding to the respective nozzles of the $1^{st}$ to $(N/2)^{th}$ nozzle rows are led to the outside of the array area on a $1^{st}$ nozzle row side; wherein the wires connected to the through hole vias corresponding to the respective nozzles of the $(N/2)+1^{th}$ to $N^{th}$ nozzle rows are led to the outside of the array area on a $N^{th}$ nozzle row side; wherein among the nozzles of the $1^{st}$ to $(N/2)^{th}$ nozzle rows, the through hole vias corresponding to the respective nozzles of a nozzle rows are provided outside of the array area, wherein a is any integer satisfying $1 \leq a < N/2$; and wherein among the nozzles of the $(N/2)+1^{th}$ to $N^{th}$ nozzle rows, the through hole vias corresponding to the respective nozzles of b nozzle rows are provided outside of the array area, wherein b is any integer satisfying $1 \leq b < N/2$.

The invention of item 3 recites the inkjet printhead according to item 2, wherein the through hole vias corresponding to the respective nozzles of the a nozzle rows are provided outside of the array area on the $1^{st}$ nozzle row side; and wherein the through hole vias corresponding to the respective nozzles of the b nozzle rows are provided outside of the array area on the $N^{th}$nozzle row side.

The invention of item 4 recites the inkjet printhead according to item 2 or 3 wherein the connection member includes a first connection member and a second connection member, the first connection member being provided outside of the array area on the $1^{st}$ nozzle row side on one surface of the circuit board, the second connection member being provided outside of the array area on the $N^{th}$ nozzle row side on the one surface of the circuit board; wherein the wires connected to the through hole vias corresponding to the respective nozzles of the $1^{st}$ to $(N/2)^{th}$ nozzle rows are connected to the first connection member; and wherein the wires connected to the through hole vias corresponding to the respective nozzles of the $(N/2)+1^{th}$ to $N^{th}$ nozzle rows are connected to the second connection member.

The invention of item 5 recites the inkjet printhead according to item 4, wherein the through hole vias corresponding to the respective nozzles of the a nozzle rows are provided on a far side of the first connection member with the first connection member disposed between the array area and each of the through hole vias corresponding to the respective nozzles of the a nozzle rows; and wherein the through hole vias corresponding to the respective nozzles of the b nozzle rows are provided on a far side of the second connection member with the second connection member disposed between the array area and each of the through hole vias corresponding to the respective nozzles of the b nozzle rows.

The invention of item 6 recites the inkjet printhead according to any one of items 1 to 5, wherein the number of the through hole vias provided inside of the array area is the same as the number of the through hole vias provided outside of the array area.

The invention of item 7 recites the inkjet printbead according to any one of items 1 to 5, wherein the number of the through hole vias provided inside of the array area is larger than the number of the through hole vias provided outside of the array area.

The invention of item 8 recites the inkjet printhead according to any one of items 1 to 7, further including: a bonding member having a communicating channel, that allows the ink channel to communicate with the pressure chamber, the bonding member being provided on a surface of the circuit board, the surface being opposite to a surface on which the connection member is provided, wherein the wire connected to the through hole via outside of the array area is disposed outside a portion where the bonding member is joined to the circuit board.

Effects of the Invention

According to the invention recited in item 1, some of the through hole vias corresponding to the nozzles are disposed inside of the array area, and the other of the through hole vias are disposed outside of the array area Therefore, not all the wires connected to the through hole vias have to run between adjacent ink channels This reduces the number of wires disposed between adjacent ink channels of the $1^{st}$ and $N^{th}$ nozzle rows where the density of wires is the highest. Accordingly, the width of each wire and the space between wires can be made larger. This achieves densely-arranged nozzles and enhances the reliability of the wires.

Further, since the wires are concentrated in one surface of the circuit board through the through hole vias, a connection member needs to be formed only on one surface of the circuit board. Accordingly, there is no need to make the circuit board multilayered, and no need to provide the connection member on both surfaces of the circuit board. This achieves more effective use of space on the circuit board with a simple structure and achieves cost reduction.

According to the invention recited in item 2, all the wires are divided into two bundles of wires the wires of one bundle are led toward the $1^{st}$ row side, and the wires of the other bundle are led toward the $N^{th}$ row side. This reduces the number of wires disposed between adjacent ink channels corresponding to the nozzles of the $1^{st}$ and $N^{th}$ rows where, the density of wires is the highest.

Accordingly, the width of each wire and the space between wires can be made larger.

Further, each of the two bundles of wires running in different directions is further divided into two bundle of wires: the wires of one bundle are connected to the respective through hole vias inside of the array area; and the wires of the other bundle are connected to the respective through hole vias outside of the array area. This further reduces the number of wires disposed between adjacent ink channels corresponding to the nozzles of the $1^{st}$ and $N^{th}$ rows. Accordingly, the width of each wire and the space between wires can be made still larger.

According to the invention recited in item 3, the through hole vias provided outside of the array area are divided and disposed on the far side the $1^{st}$ row and $N^{th}$ row, i.e., disposed in the opposite directions with respect to the array area. This can achieve effective use of space for wires, and allows the width of each wire and the space between wires to be larger.

According to the invention recited in item 4, the wires led toward the $1^{th}$ row are connected to a first connection member on the $1^{st}$ row side, and the wires led toward the $N^{th}$ row are connected to a second connection member on the $N^{th}$ row side. This structure can shorten the distance between each through hole via and the connection member to be connected, which allows the wires to be shorter.

According to the invention recited in item 5, the connection member is disposed between the array area and the through hole vias. Accordingly, the wires are connected to the connection member from both sides thereof. This allows the width of each wire and the space between wires around the connection member to be larger, resulting in effective use of space for wires.

According to the invention recited in item 6, there is not a large difference in the width of each wire and in the space between wires between two surfaces of the circuit board. This allows the width of each wire and the space between wires to be larger, resulting in effective use of space for wires.

According to the invention recited in item 7, an ink channel to supply ink to the corresponding pressure chamber is provided on one surface of the circuit board, which surface is closer piezoelectric elements than the other surface. Each wire, therefore, has to be disposed avoiding the ink channel. Accordingly, the space for wires on this surface is smaller than the other surface.

On the surface on which the ink channel is provided, the wires, which are connected to the respective through hole vias disposed outside of the array area, are provided. In view of this, the number of wires on the surface on which the ink channel is provided may be smaller than the number of wires connected to the respective through hole vias disposed inside of the array area. Therefore, the width of each wire and the space between wires are well-balanced between both surfaces of the circuit board.

According to the invention recited in item 8, the wires connected to the respective through hole vias outside of the two-dimensional-array area are disposed outside the portions where the bonding members are joined to the circuit board. This prevents deterioration of joint strength between the bonding member and the circuit board.

BRIEF DESCRIPTION OF DRAWINGS

FIG. 12 shows a table comparing spaces allowed for one wire by varying a nozzle density, the number of nozzle rows, and the layout of wires;

BEST MODE FOR CARRYING OUT THE INVENTION

The explanations about an inkjet printhead will be given below with reference to the drawings. The inkjet printhead according to the present invention is included in an inkjet recording apparatus.

[First Embodiment]

<Inkjet Recording Apparatus>

Figure 1:
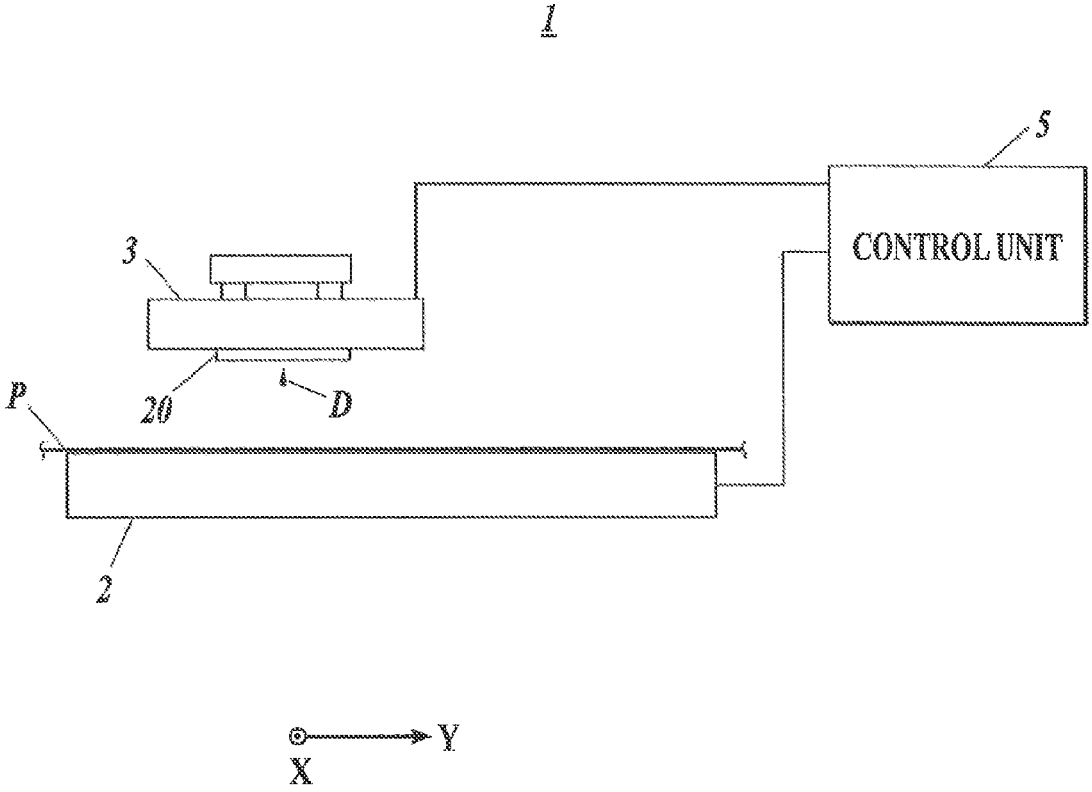
FIG. 1 is a schematic view of major parts of an inkjet recording apparatus.

FIG. 1 is a schematic view of major parts of an inkjet recording apparatus 1. As shown in FIG. 1, the inkjet recording apparatus 1 includes a conveying unit 2 that conveys a recording medium P in the direction of arrow Y (hereinafter referred to as conveyance direction Y). The recording medium P is not particularly limited to a specific material. For example, a sheet of paper or cloth; a plastic film or a metal that does not absorb ink may be used as the recording medium P. The paper mentioned herein includes not only ink-absorbing paper exclusively for an inkjet printer, but also coated paper, art paper, and regular paper that do not absorb much ink.

An inkjet printhead 3 is disposed above the conveying unit 2. The inkjet printhead 3 elects ink drops D to the recording medium P on the conveying unit 2. The inkjet printhead 3 has a plurality of nozzles 11 through which ink drops D are ejected. The nozzles 11 are arrayed in the X and Y directions (see FIG. 2).

The conveying unit 2 and the inkjet printhead 3 are connected to a control unit 5 and controlled by the control unit 5.

Figure 2:
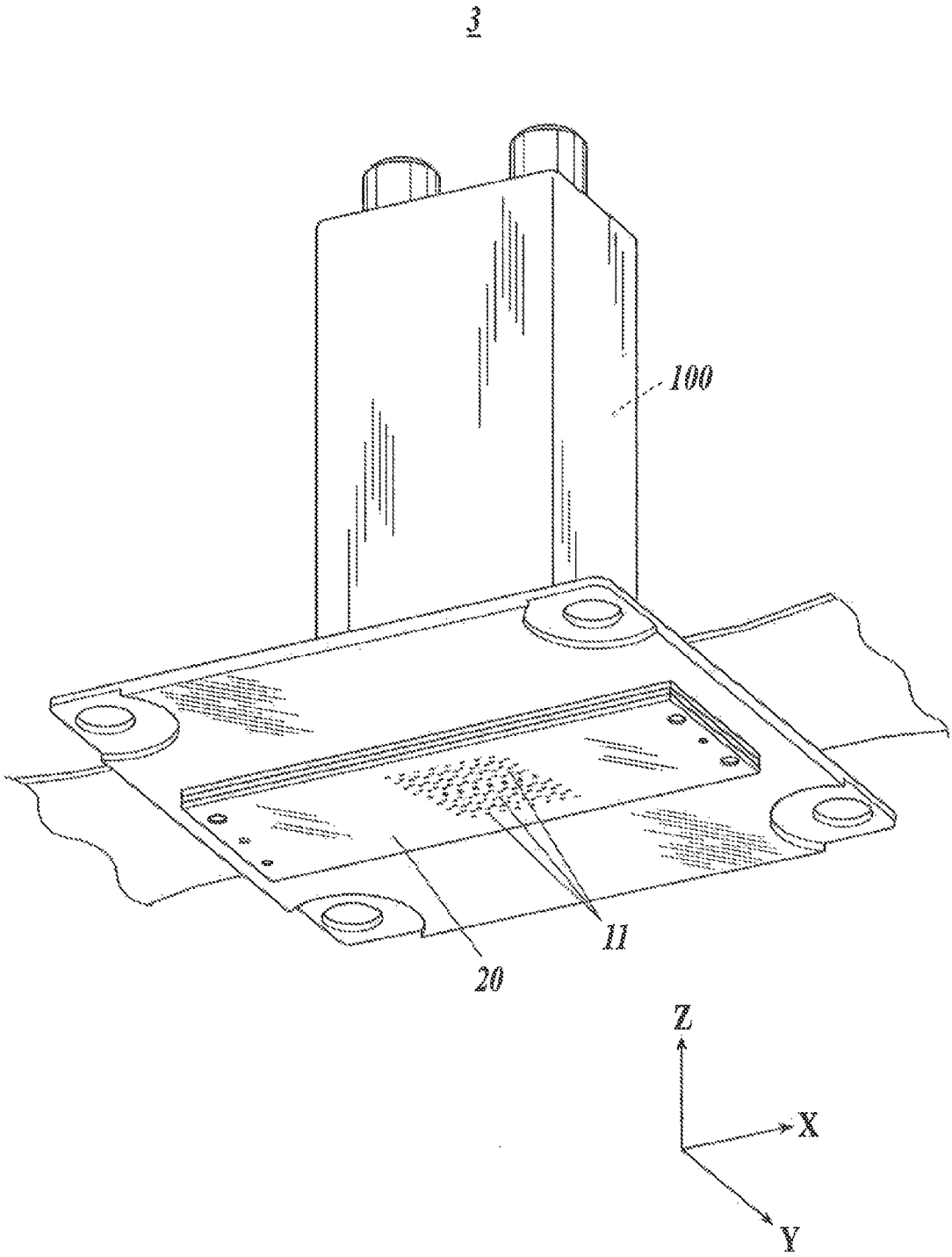
FIG. 2 is a perspective view of an inkjet printhead.

FIG. 2 is a perspective view of the inkjet printhead 3.

As shown in FIG. 2, the inkjet printhead 3 has a nozzle plate 20 at the lower end thereof including a plurality of nozzles 11 to eject ink drops D.

<Structure of Inkjet Printhead>

Figure 3:
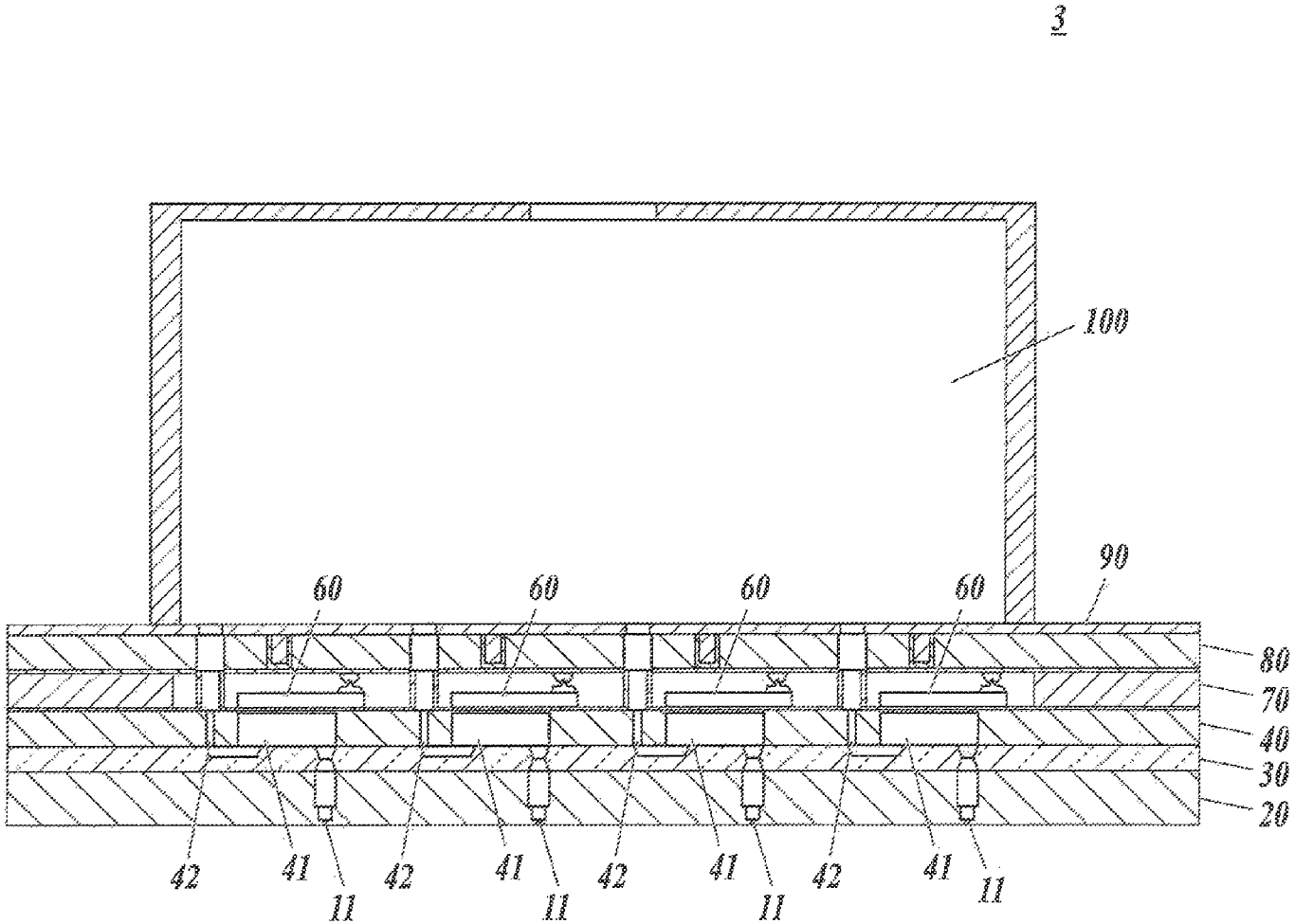
FIG. 3 is a vertical cross-sectional view of the inkjet printhead.
Figure 4:
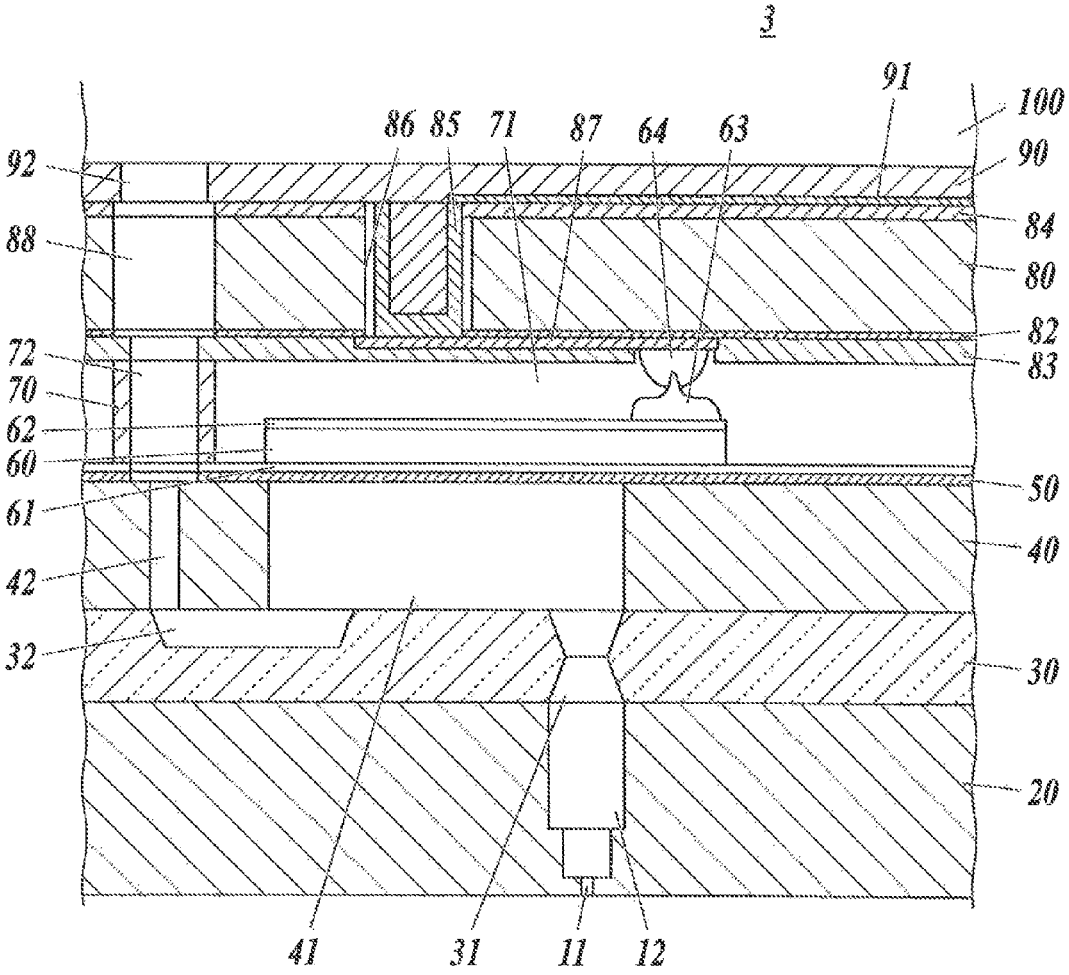
FIG. 4 is an enlarged view of one of piezoelectric elements and its surroundings of FIG. 3.

FIG. 3 is a vertical cross-sectional view of the inkjet printhead, and FIG. 4 is an enlarged view of one of the piezoelectric elements and its surroundings of FIG. 3.

The inkjet printhead 3 includes a head board 150, a circuit board 80, and a bonding member to bond the head board 150 and the circuit board 80, with the boards 150 and 80 and the bonding member being laminated. The head board 150 is composed of three laminated plates, i.e., the nozzle plate 20, an intermediate plate 30, and a pressure chamber plate 40.

(Nozzle Plate)

As shown in FIG. 3 and FIG. 4, the inkjet printhead 3 includes the nozzle plate 20 as a nozzle substrate having a plurality of nozzles 11 to eject ink. The nozzle plate 20, which has the nozzles 11 to eject ink downward, is disposed at the bottom of the inkjet printhead 3. The nozzle plate 20 is made of silicon as base material. Ink channels 12 and the nozzles 11 are formed in the nozzle plate 20 by dry etching.

(Intermediate Plate)

The intermediate plate 30, which is made of glass, has ink channels 31 and ink channels 32. Each of the ink channels 31 leads to the corresponding nozzle 11. Each of the ink channels 32 connects a pressure chamber 41 with an ink channel 42 provided in the pressure chamber plate 40, which will be described later. The ink channels 31 and 32 may be formed by sandblasting, for example. The intermediate plate 30 is bonded to the nozzle plate 20 by anodic bonding, for example. The anodic bonding heats the intermediate plate 30 (300-500 degrees Celsius), applies voltage between the nozzle plate 20 and the intermediate plate 30, and thereby bonds the plates 20 and 30 with electrostatic attraction. The anodic bonding eliminates the need for an adhesive to stick the plates 20 and 30 to each other, and eliminates the danger of deterioration in durability owing to solvent ink. This enhances the reliability of the laminated plates.

The ink channels 31 are disposed such that each ink channel 31 communicates with the corresponding ink channel 12 when the intermediate plate 30 is laid on the nozzle plate 20.

(Pressure Chamber Plate)

The pressure chamber plate 40, which is made of a silicon substrate, has pressure chambers 41 and inlets (narrow channels) 42. Each of the pressure chambers 41 individually corresponds to a nozzle 11. Each of the inlets 42 serves as an ink channel to a pressure chamber 41. The pressure chambers 41 and the inlets 42 are formed by dry etching for example.

The pressure chamber plate 40 is anodically bonded to the intermediate plate 30, which is a glass substrate. In bonding the plates 40 and 30, the plates 40 and 30 are positioned so that each of the pressure chambers 41 communicates with an ink channel 31 provided in the intermediate plate 30. The anodic bonding here is the same as the anodic bonding for the intermediate plate 30 mentioned above. The pressure chamber plate 40 has the pressure chambers 41 to store ink to be ejected through the nozzles 11. Each of the pressure chambers 41 penetrates the pressure chamber plate 40 in the thickness direction thereof.

The pressure chamber plate 40 has the inlets (narrow channels) 42 each of which serves as an ink channel to a pressure chamber 41. Each of the inlets 42 penetrates the pressure chamber plate 40 in the thickness direction thereof. The inlets 42 are formed by dry etching so that each of the inlets 42 is narrower than the other ink channels. This enables each inlet 42 to determine the channel resistance, and therefore, can achieve desired properties of ejecting, such as a drop diameter and an ejecting frequency.

While a pressure chamber 41 and inlet 42 are separate from each other in the pressure chamber plate 40, a pressure chamber 41 and the corresponding inlet 42 communicate with each other through an ink channel 32 provided in the intermediate plate 30 when the pressure chamber plate 40 is laid on the intermediate plate 30. Thus, ink flows through an inlet 42 and ink channel 32, and is stored in the corresponding pressure chamber 41.

(Vibration Plate)

The pressure chamber plate 40 is provided with a vibration plate 50. Specifically, the vibration plate 50 is provided on the pressure chamber plate 40 so that the vibration plate 50 covers the openings of the pressure chambers 41 but does not cover the inlets 42. That is, the vibration plate 50 constitutes a wall of each pressure chamber 41.

The vibration plate 50, which is a thin plate, changes the pressure in a pressure chamber 41 when the vibration plate 50 is displaced in the thickness direction (i.e., when the vibration plate 50 is elastically deformed).

(Piezoelectric Element)

Figure 5:
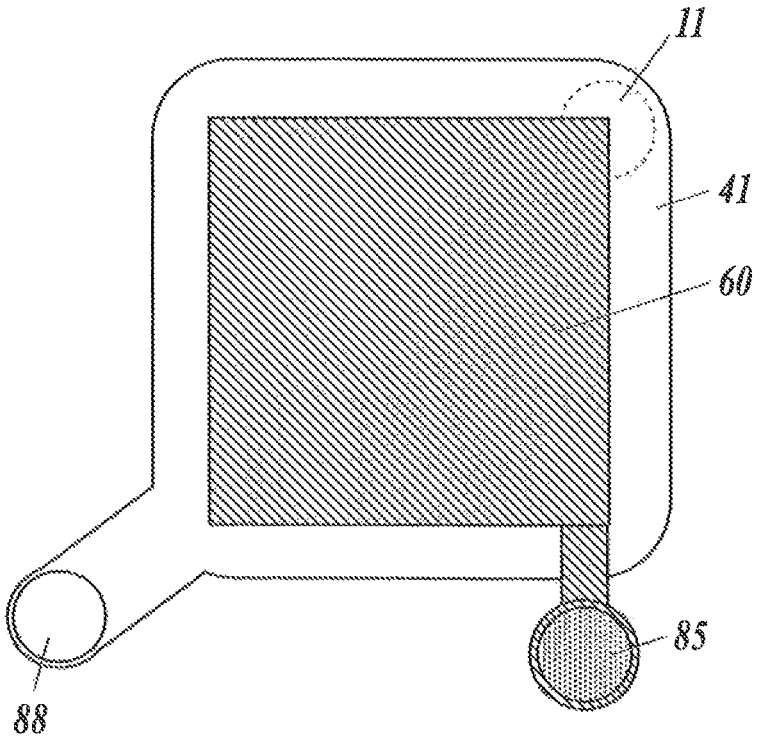
FIG. 5 shows the positional relationship of a pressure chamber, an ink channel, and a piezoelectric element.

FIG. 5 shows the positional relationship of a pressure chamber 41, an ink channel 88, and a piezoelectric element 60, which will be described later.

As shown in FIG. 4 and FIG. 5, piezoelectric elements 60 are provided over the vibration plate 50 at positions corresponding to the respective pressure chambers 41 with the vibration plate 50 disposed between the piezoelectric elements 60 and the pressure chambers 41.

The piezoelectric element 60 is an actuator made of PZT (lead zirconate titanate) and is provided for each of the pressure chambers 41. The piezoelectric element 60 applies force to eject the ink in the corresponding pressure chamber 41 through the corresponding nozzle 11.

Each piezoelectric element 60 is sandwiched by two electrodes 61 and 62 from below and above. The lower electrode 61 is provided on the vibration plate 50.

The piezoelectric element 60 and the electrodes 61 and 62 are formed on the vibration plate 50 by forming a pattern using etching, for example.

When voltage is applied to the electrodes 61 and 62, the piezoelectric element 60 sandwiched between the electrodes 61 and 62 is deformed, which in turn deforms the vibration plate 50. This motion of the vibration plate 50 allows the ink in the corresponding pressure chamber 41 to be elected through the nozzle as ink drops D (see FIG. 1).

(Bonding Member)

The vibration plate 50 is provided with a bonding member 70 as an insulating layer. The pressure chamber plate 40 and the circuit board 80 are bonded to each other through the bonding member 70.

The bonding member 70 is made of resin and formed as a pillar having an ink channel 72 (communicating channel) that allows an inlet 42 provided in the pressure chamber plate 40 to communicate with an ink channel 88 provided on the circuit board 80, which will be described later.

The bonding member 70 has a space 71 to contain a piezoelectric element 60 and electrodes 61 and 62. The space 71 is disposed at the position corresponding to each of the pressure chambers 41, with the vibration plate 50 disposed between the space 71 and the corresponding pressure chamber 41. The space 71 penetrates the bonding member 70 in the thickness direction thereof. A plurality of spaces 71 are provided each of which individually contains a piezoelectric element 60.

The ink channel 72 is formed separately from the space 71 in the bonding member 70 and penetrates the bonding member 70 in the thickness direction thereof.

The bonding member 70 extends across almost the entire area of the outer part of the inkjet printhead 3 to bond the pressure chamber plate 40 and the circuit board 80 to each other. Specifically, the outer part of the inkjet printhead 3 is an area outside of a two-dimensional-array area where the nozzles 11, pressure chambers 41, and piezoelectric elements 60 are arranged in a two-dimensional array.

(Circuit Board)

The circuit board 80 is laid on and bonded to the bonding member 70. The circuit board 80 is made of silicon as base material.

On the lower surface of the circuit board 80, two insulating layers 82 and 83 made of silicon oxide are formed. On the upper surface of the circuit board 80, an insulating layer 84 which is also made of silicon oxide is formed. The insulating layer 83, i.e., the lower one of the insulating layers 82 and 83, is in contact with and is bonded to the upper surface of the bonding member 70. The circuit board 80 has electrode through-holes 86 each of which penetrates the circuit board 80 in the thickness direction thereof. A through hole via (penetrating electrode) 85 penetrates through each of the electrode through-holes 86 to displace a piezoelectric element 60 when drive voltage is applied to an electrode 62. One end of each first wire 87 which extends in the horizontal direction is connected to the lower end of the corresponding through hole via 85. The other end of each first wire 87 is connected to a stud bump 63 through a solder 64 exposed in the space 71, which stud bump 63 is provided on the electrode 62 on the upper surface of the piezoelectric element 60. The first wire 87 is protected by being sandwiched by the two insulating layers 82 and 83 disposed on the lower surface of the circuit board 80. The first wires 87 are made of highly-conductive material such as aluminum and copper.

The insulating layers 82 and 83 provided on the lower surface of the circuit board 80 insulate the circuit board 80 itself from the first wire 87; and the insulating layer 84 provided on the upper surface of the circuit board 80 insulates the circuit board 80 itself from the second wire 91.

Second wires 91 are provided on the upper surface of the circuit board 80 through the insulating layer 84. Further, the protective layer 90 is provided on the second wires 91. The second wires 91 are made of highly-conductive material such as aluminum and copper.

The protective layer 90 is a photosensitive adhesive to bond a member constituting a wall of a common ink tank 100 placed on the protective layer 90. The protective layer 90 also protects the second wires 91. Each of the second wires 91 extends in the horizontal direction. One end of each second wire 91 is connected to the upper end of the corresponding through hole via 85, and the other end of each second wire 91 is connected to a connection member 110 or 111 (see FIG. 6A and FIG. 6B) each of which connects to a drive circuit. A first wire 87 and a second wire 91 are separately connected to the corresponding piezoelectric element 60, and a through hole via 85 connects the first wire 87 and the second wire 91 to each other. The connection members 110 and 111 are provided on the upper surface of the circuit board 80.

The circuit board 80 has ink channels 88 each of which penetrates the circuit board 80 in the thickness direction thereof. The ink channels 88 allow the ink to flow to the respective pressure chambers 41. The ink channels 88 are disposed such that each ink channel 88 communicates with the corresponding ink channel 72 when the circuit board 80 is laid on the bonding member 70.

(Protective Layer)

The protective layer 90 which serves as an insulating layer is provided on the upper surface (opposite to the surface on which the bonding member 70 is provided) of the circuit board 80. The protective layer 90 protects the second wires 91 provided on the upper surface of the circuit board 80.

The protective layer 90 has ink channels 92 each, of which penetrates the protective layer 90 in the thickness direction thereof. The ink channels 92 allow the ink to lead to the respective pressure chambers 41. The ink channels 92 are disposed such that each ink channel 92 communicates with the corresponding ink channel 88 provided in the bonding member 80 when the circuit board 90 is laid on the bonding member 80.

(Common Ink Tank)

Over the upper surface of the circuit board 80, the common ink tank 100 is provided through the protective layer 90. The member constituting a wall of the common ink tank 100 is bonded to the circuit board 80 with a fixing means such as an adhesive.

The common ink tank 100 communicates with the pressure chambers 41 through the ink channels in each layer. The common ink tank 100 communicates with all the pressure chambers 41 through the ink channels to supply ink to all the pressure chambers 41.

<Wires>

Figure 6A:
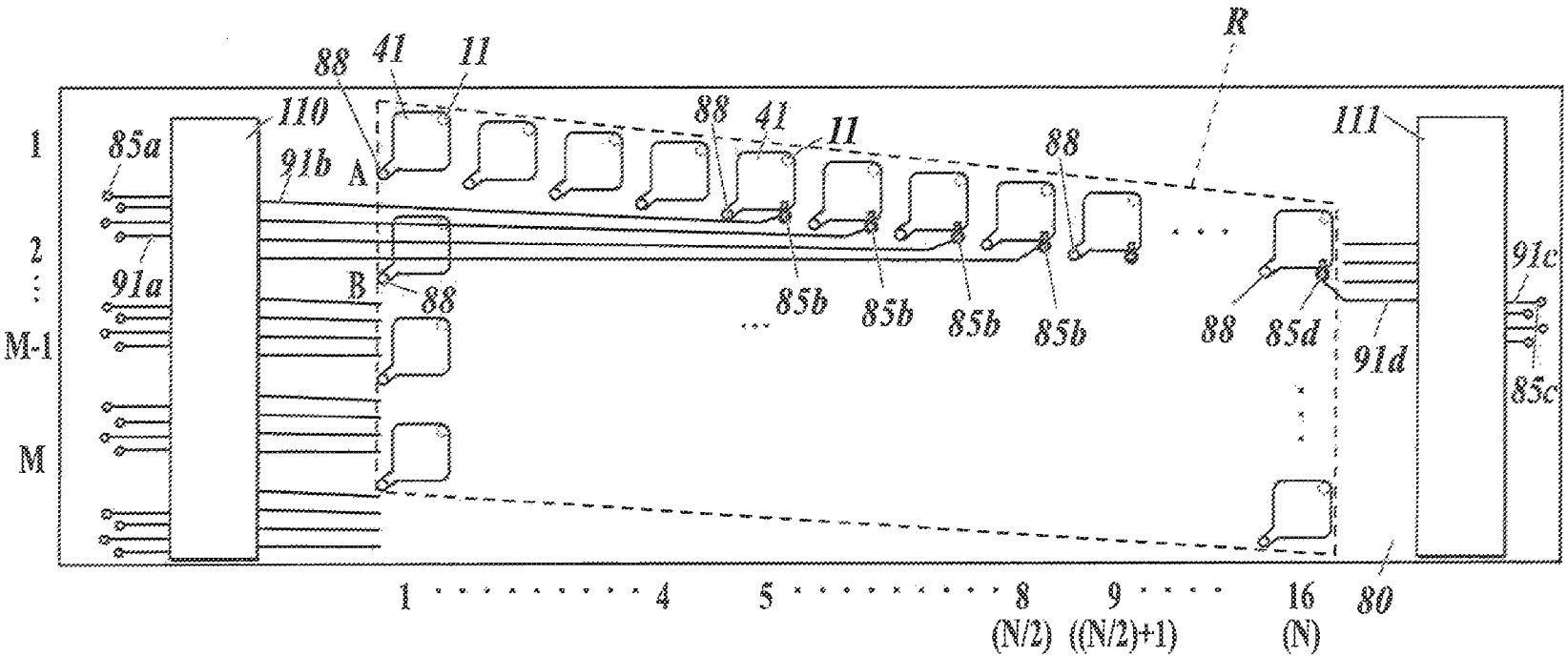
FIG. 6A shows the layout on the upper surface of a circuit board, i.e., shows the layout of nozzles, pressure chambers, through hole vias, second wires, and connection members in a first embodiment.
Figure 6B:
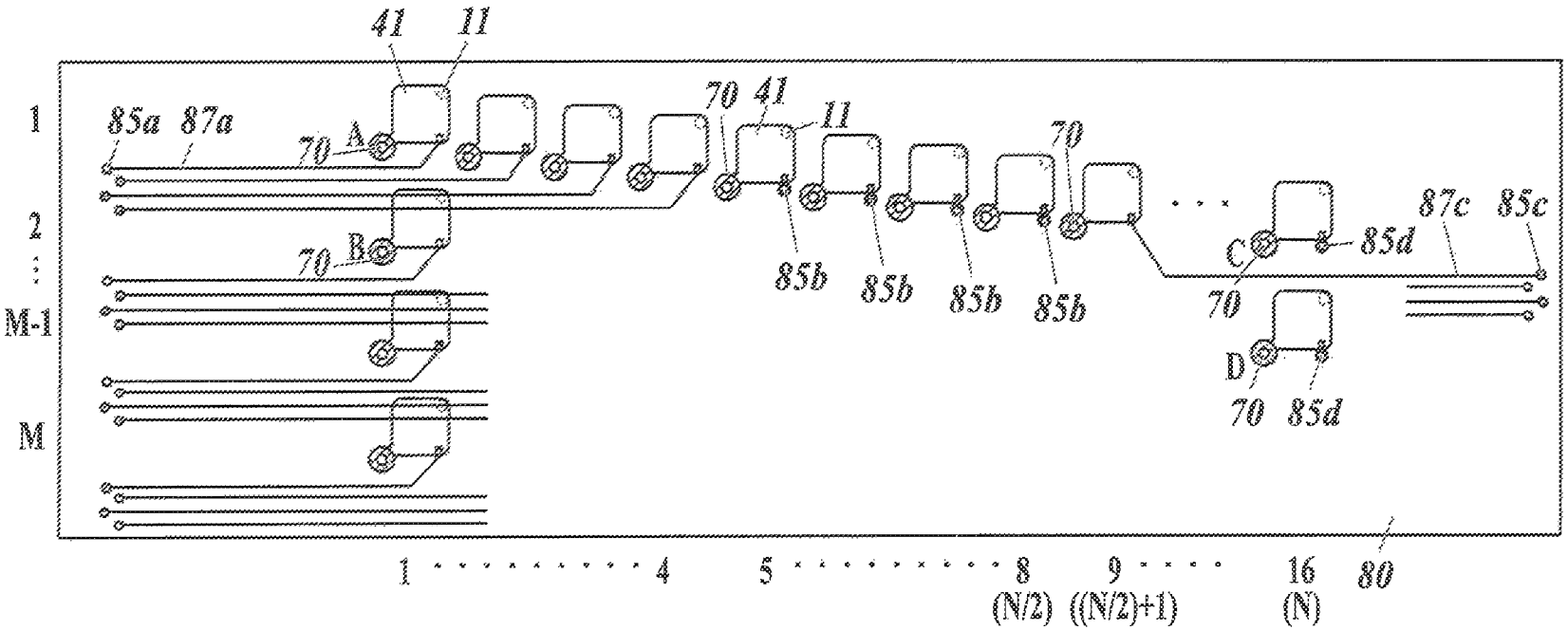
FIG. 6B shows the layout on the lower surface of the circuit board, i.e., shows the layout of the nozzles, pressure chambers, through hole vias, second wires, and connection members in the first embodiment.

The layout of the wires 87 and 91, through hole vias 85, and connection members 110 and 111 will be described. Since FIG. 6A and FIG. 6B are drawn in landscape orientation due to limitations of space, the explanations below are given on the basis that FIG. 6A and FIG. 6B are seen from the right. That is, the left side of each of FIG. 6A and FIG. 6B is referred to as the upper side, the right side referred to as the lower side, the upper side referred to as the right side, and the lower side referred to as the left side when each of FIG. 6A and FIG. 6B is seen from the front.

Figure 7:
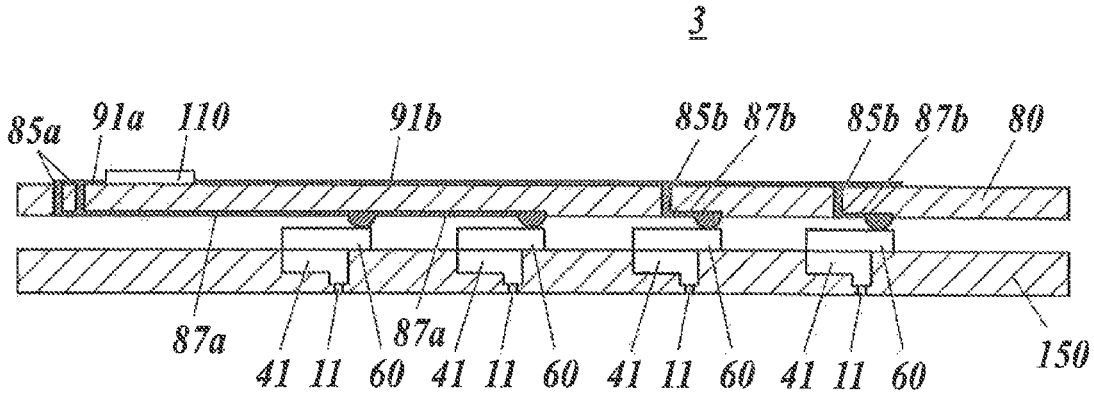
FIG. 7 is a cross-sectional view of the circuit board in the first embodiment.

FIG. 6A and FIG. 6B show the layout of wires. More specifically, FIG. 6A shows the layout of wires on the upper surface of the circuit board 80; and FIG. 6B shows the layout of wires on the lower surface of the circuit board 80. Although the nozzles and pressure chambers are actually provided in different layers of the head board 150, all the components except the nozzles 11 are drawn in solid lines in FIG. 6A and FIG. 6B to clearly indicate the layout of the components. FIG. 7 is a cross-sectional view of the circuit board 80 and head board 150 to explain the layout of wires.

As shown in FIG. 6A and FIG. 6B, N nozzle rows (N is an even number of 2 or more) are arranged in X direction in the undermost layer of the head board 150. M lines of nozzles (M is an integer of 2 or more) are arranged in Y direction. That is, M×N nozzles 11 are arranged. The nozzle rows are slightly displaced with respect to one another in Y direction. More specifically, the nozzles 11 are two-dimensionally arrayed, and the pressure chambers 41 and piezoelectric elements 60 which are provided at the positions corresponding to the respective nozzles 11 are also two-dimensionally arrayed. An array area where the nozzles 11 are two-dimensionally arrayed is hereinafter referred to as a two-dimensional-array area R.

The first connection member 110 is provided in one end portion in X direction (the left portion of each of FIG. 6A and FIG. 6B) of the inkjet printhead 3, and the second connection member 111 is provided in the other end portion in X direction (the right portion of each of FIG. 6A and FIG. 6B) of the inkjet printhead 3. The two connection members 110 and 111 are provided outside of the two-dimensional-array area R where the nozzles 11, pressure chambers 41, and piezoelectric elements 60 are two-dimensionally arrayed.

Here, the leftmost nozzle row (i.e., nozzle row closest to the first connection member) is defined as the $1^{st}$ row, the rightmost nozzle row (i.e., nozzle row closest to the second connection member) is defined as the NTh row, the uppermost nozzle line is defined as the $1^{st}$ line, and the lowermost nozzle line is defined as the $M^{th}$ line in FIG. 6A and FIG. 6B. The wires 87 and 91 corresponding to the nozzles 11 from the $1^{st}$ to $(N/2)^{th}$ rows are connected to the first connection member 110, and the wires 87 and 91 corresponding to the nozzles 11 from the $(N/2)+1^{th}$ to $N^{th}$ rows are connected to the second connection member 111. The following explanations are given assuming that there are sixteen nozzle rows (i.e., N=16), the wires 87 and 91 of the left half of the nozzle rows ($1^{st}$ to $8^{th}$ nozzle rows) are connected to the first connection member 110, and that the wires 87 and 91 of the right half of the nozzle rows ($9^{th}$ to $16^{th}$ nozzle rows) are connected to the second connection member 111.

(Wires Corresponding to Nozzles of $1^{st}$ to $8^{th}$ Nozzle Rows)

Among the through hole vias 85 corresponding to the nozzles 11 of the $1^{st}$ to $8^{th}$ rows, the through hole vias 85*a* corresponding to the nozzles 11 of the $1^{st}$ to $4^{th}$ rows are provided outside of the two-dimensional-array area R on the far side of the $1^{st}$ nozzle row. More specifically, the through hole vias 85*a* corresponding to the nozzles 11 of the $1^{st}$ to $4^{th}$ rows are provided on the far side of the first connection member 110 with the first connection member 110 disposed between each through hole via 85*a* and the two-dimensional-array area R on the circuit board 80.

Among the through hole vias 85 corresponding to the nozzles 11 of the $1^{st}$ to $8^{th}$ rows, the through hole vias 85*b* corresponding to the nozzles 11 of the $5^{th}$ to $8^{th}$ rows are provided inside of the two-dimensional-array area R. More specifically, each of the through hole vias 85*b* corresponding to the nozzles 11 of the $5^{th}$ to $8^{th}$ rows is provided above the corresponding piezoelectric element 60 on the circuit board 80.

Each of the ink channels 88 corresponding to the nozzles 11 of the $5^{th}$ to $8^{th}$ rows is disposed closer to the first connection member 110 (i.e., the $1^{st}$ nozzle row side) than the corresponding through hole via 85*b*. More specifically, an ink channel 88 is disposed to the left of the corresponding through hole via 85*b*, i.e., an ink channel 88 is disposed between the corresponding through hole via 85*b* and the first connection member 110 in FIG. 6A and FIG. 6B.

As shown in FIG. 6B and FIG. 7, the first wires 87*a* corresponding to the nozzles 11 of the $1^{st}$ to $4^{th}$ rows are disposed on the lower surface of the circuit board 80. One end of each first wire 87*a* is connected to the corresponding piezoelectric element 60, and the other end thereof is connected to the lower end of the corresponding through hole via 85*a*.

As shown in FIG. 6A and FIG. 7, the second wires 91*a* corresponding to the nozzles 11 of the $1^{st}$ to $4^{th}$ rows are disposed over the upper surface of the circuit board 80. One end of each second wire 91*a* is connected to the upper end of the corresponding through hole via 85*a*, and the other end thereof is connected to the first connection member 110 through the far side of the first connection member 110 with respect to the two-dimensional-array area R.

More specifically, each of the wires of the $1^{st}$ to $4^{th}$ nozzle rows is led from the corresponding piezoelectric element 60 toward the first connection member 110 (i.e., toward the $1^{st}$ it nozzle row side) to the outside of the two-dimensional-array area R. Then, the wire is turned back at the corresponding through hole via 85*a* and is connected to the first connection member 110.

Each of the first wires 87*a* corresponding to the nozzles 11 of the $1^{st}$ to $4^{th}$ rows in the $1^{st}$ line passes between the bonding member 70 corresponding to the nozzle 11 of the $1^{st}$ line and that of the $2^{nd}$ line (i.e., between A and B in FIG. 6B) and is connected to the first connection member 110. In the similar manner, each of the wires corresponding to the nozzles 11 of the $2^{nd}$ to $(M-1)^{th}$ lines passes between the corresponding bonding member 70 and the bonding member 70 immediately below, and is connected to the first connection member 110. The wires corresponding to the nozzles 11 of the $M^{th}$ line pass through an area below and adjacent to the $M^{th}$ line and are connected to the first connection member 110.

That is, the first wires 87*a* connected to the respective through hole vias 85*a* on the lower surface of the circuit board 80 are disposed outside the portion where the bonding member 70 is joined to the lower surface of the circuit board 80.

As described above, among the through hole vias 85 corresponding to the nozzles 11 of the $1^{st}$ to $8^{th}$ rows, the through hole vias 85*b* corresponding to the nozzles 11 of the $5^{th}$ to $8^{th}$ rows are provided inside of the two-dimensional-array area. R. More specifically, each of the through hole vias 85*b* corresponding to the nozzles 11 of the $5^{th}$ to $8^{th}$ rows is disposed above the corresponding piezoelectric elements 60 on the circuit board 80.

As shown in FIG. 7, the first wires 87*b* corresponding to the nozzles 11 of the $5^{th}$ to $8^{th}$ rows are disposed on the lower surface of the circuit board 80. One end of each first wire 87*b* is connected to the corresponding piezoelectric element 60, and the other end thereof is connected to the lower end of the corresponding through hole via 85*b*.

As shown in FIG. 6A and FIG. 7, the second wires 91*b* corresponding to the nozzles 11 of the $5^{th}$ to $8^{th}$ rows are disposed on the upper surface of the circuit board 80. One end of each second wire 91*b* is connected to the upper end of the corresponding through hole via 85*b*, and the other end thereof is connected to the first connection member 110.

More specifically, each of the wires of the $5^{th}$ to $8^{th}$ nozzle rows is led from a through hole via 85*b* to the upper surface of the circuit board 80 above the corresponding piezoelectric element 60, and is led toward the first connection member 110 (i.e., toward the $1^{st}$ nozzle row side) to the outside of the two-dimensional-array area R. Thus, the wire is connected to the first connection member 110.

Each of the second wires 91*b* corresponding to the nozzles 11 of the $5^{th}$ to $8^{th}$ rows in the $1^{st}$ line passes between the ink channel 88 corresponding to the nozzle 11 of the $1^{st}$ line and that of the $2^{nd}$ line (i.e., between A and B in FIG. 6A) and is connected to the first connection member 110. In the similar manner, each of the wires corresponding to the nozzles 11 of the $2^{nd}$ to $(M-1)^{th}$ lines passes between the corresponding ink channel 88 and the ink channel 88 immediately below, and is connected to the first connection member 110. The wires corresponding to the nozzles 11 of the $M^{th}$ line pass through an area below and adjacent to the $M^{th}$ line and are connected to the first connection member 110.

(Wires Corresponding to Nozzles of $9^{th}$ to $16^{th}$ Nozzle Rows)

Among the through hole vias 85 corresponding to the nozzles 11 of the $9^{th}$ to $16^{th}$ rows, the through hole vias 85*c* corresponding to the nozzles 11 of the $9^{th}$ to $12^{th}$ rows are provided outside of the two-dimensional-array area R on the far side of the $16^{th}$ nozzle row. More specifically, the through hole vias 85*c* corresponding to the nozzles 11 of the $9^{th}$ to $12^{th}$ rows are provided on the far side of the second connection member 111 with the second connection member 111 disposed between each through hole via 85*c* and the two-dimensional-array area R on the circuit board 80.

Among the through hole vias 85 corresponding to the nozzles 11 of the $9^{th}$ to $16^{th}$ rows, the through hole vias 85*d* corresponding to the nozzles 11 of the $13^{th}$ to $16^{th}$ rows are provided inside of the two-dimensional-array area R. More specifically, each of the through hole vias 85*d* corresponding to the nozzles 11 of the $13^{th}$ to $16^{th}$ rows is provided above the corresponding piezoelectric element 60 on the circuit board 80.

Each of the through hole vias 85*d* corresponding to the nozzles 11 of the $13^{th}$ to $16^{th}$ rows is disposed closer to the second connection member 111 (i.e., the $16^{th}$ nozzle row side) than the corresponding ink channel 88. More specifically, a through hole via 85*d* is disposed to the right of the corresponding ink channel 88, i.e., a through hole via 85*d* is disposed between the corresponding ink channel 88 and the second connection member 111 in FIG. 6A and FIG. 6B.

As shown in FIG. 6B, the first wires 87*c* corresponding to the nozzles 11 of the $9^{th}$ to $12^{th}$ rows are disposed on the lower surface of the circuit board 80. One end of each first wire 87*c* is connected to the corresponding piezoelectric element 60, and the other end thereof is connected to the lower end of the corresponding through hole via 85*c*.

As shown in FIG. 6A, the second, wires 91*c* corresponding to the nozzles 11 of the $9^{th}$ to $12^{th}$ rows are disposed on the upper surface of the circuit board 80. One end of each second wire 91*c* is connected to the upper end of the corresponding through hole via 85*c*, and the other end thereof is connected to the second connection member 111 through the far side of the second connection member 111 with respect to the two-dimensional-array area R.

More specifically, each of the wires of the $9^{th}$ to $12^{th}$ nozzle rows is led from the corresponding piezoelectric element 60 toward the second connection member 111 (i.e., toward the $16^{th}$ nozzle row side) to the outside of the two-dimensional-array area R. Then, the wire is turned back at the corresponding through hole via 85*c* and is connected to the second connection member 111.

Each of the first wires 87*c* corresponding to the nozzles 11 of the $9^{th}$ to 12 rows in the $1^{st}$ line passes between the bonding member 70 corresponding to the nozzle 11 of the $1^{st}$ line and that of the $2^{nd}$ line (i.e., between C and D in FIG. 6A and FIG. 6B) and is connected to the second connection member 111. In the similar manner, each of the wires corresponding to the nozzles 11 of the $2^{nd}$ to $(M-1)^{th}$ lines passes between the corresponding bonding member 70 and the bonding member 70 immediately below, and is connected to the second connection member 111. The wires corresponding to the nozzles 11 of the $M^{th}$ line pass through an area below and adjacent to the $M^{th}$ line and are connected to the second connection member 111.

That is, the first wires 87*c* connected to the respective through hole vias 85*c* on the lower surface of the circuit board 80 are disposed outside the portion where the bonding member 70 is joined to the lower surface of the circuit board 80.

As described above, among the through hole vias corresponding to the nozzles 11 of the $9^{th}$ to $16^{th}$ rows, the through hole vias 85*d* corresponding to the nozzles 11 of the $13^{th}$ to $16^{th}$ rows are provided inside of the two-dimensional-array area R. More specifically, each of the through hole vias 85*d* corresponding to the nozzles 11 of the $13^{th}$ to $16^{th}$ rows is disposed above the corresponding piezoelectric elements 60 on the circuit board 80.

As shown in FIG. 6B, the first wires (not shown) corresponding to the nozzles 11 of the $13^{th}$ to $16^{th}$ rows are disposed on the lower surface of the circuit board 80. One end of each first wire is connected to the corresponding piezoelectric element 60, and the other end thereof is connected to the lower end of the corresponding through hole via 85*d*.

As shown in FIG. 6A, the second wires 91*d* corresponding to the nozzles 11 of the $13^{th}$ to $16^{th}$ rows are disposed on the upper surface of the circuit board 80. One end of each second wire 91*d* is connected to the upper end of the corresponding through hole via 85*d*, and the other end thereof is connected to the second connection member 111.

More specifically, each of the wires of the $13^{th}$ to $16^{th}$ nozzle rows is led from a through hole via 85*d* to the upper surface of the circuit board 80 above the corresponding piezoelectric element 60, and is led toward the second connection member 111 (i.e., toward the $16^{th}$ nozzle row side) to the outside of the two-dimensional-array area R. Thus, the wire is connected to the second connection member 111.

Each of the second wires 91*d* corresponding to the nozzles 11 of the $13^{th}$ to $16^{th}$ rows in the $1^{st}$ line passes between the ink channel 88 corresponding to the nozzle 11 of the $1^{st}$ line and that of the $2^{d}$ line and is connected to the second connection member 111. In the similar manner, each of the wires corresponding to the nozzles 11 of the $2^{nd}$ to $(M-1)^{th}$ lines passes between the corresponding ink channel 88 and the ink channel 88 immediately below, and is connected to the second connection member 111. The wires corresponding to the nozzles 11 of the $M^{th}$ line pass through an area below and adjacent to the $M^{th}$ line and are connected to the second connection member 111.

[Second Embodiment]

Figure 8A:
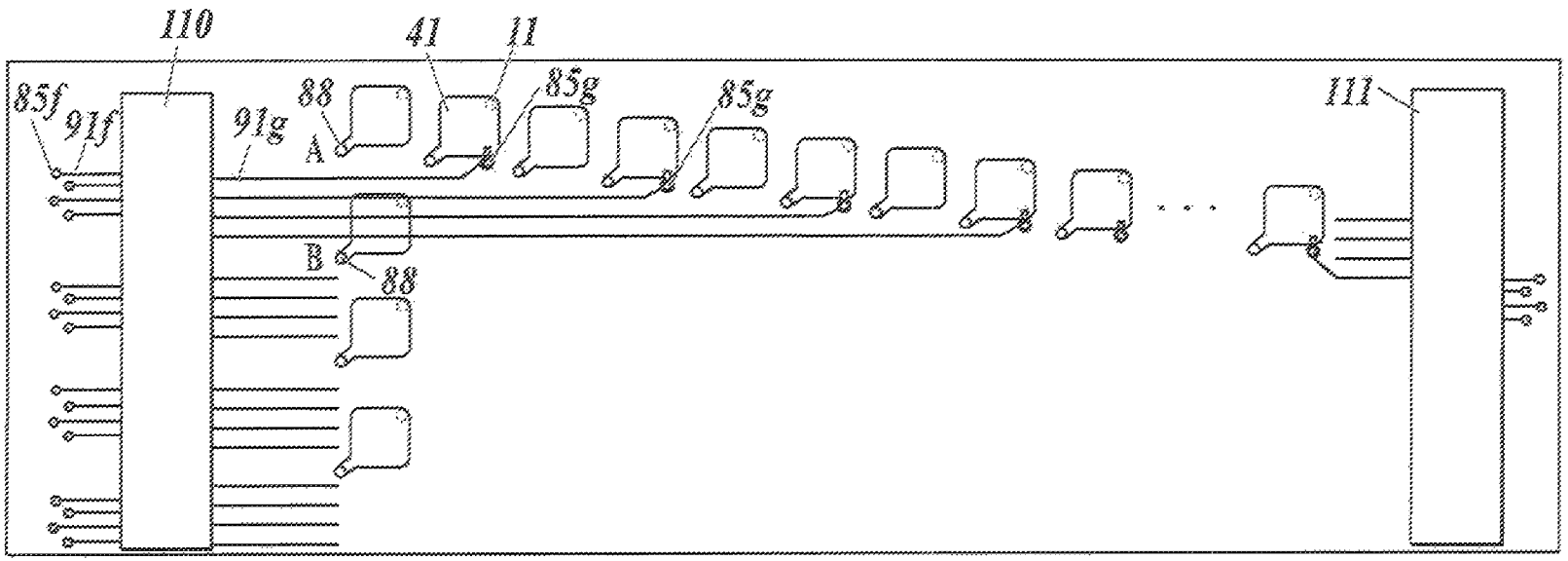
FIG. 8A shows the layout on the upper surface of a circuit board, i.e., shows the layout of nozzles, pressure chambers, through hole vias, second wires, and connection members in a second embodiment.
Figure 8B:
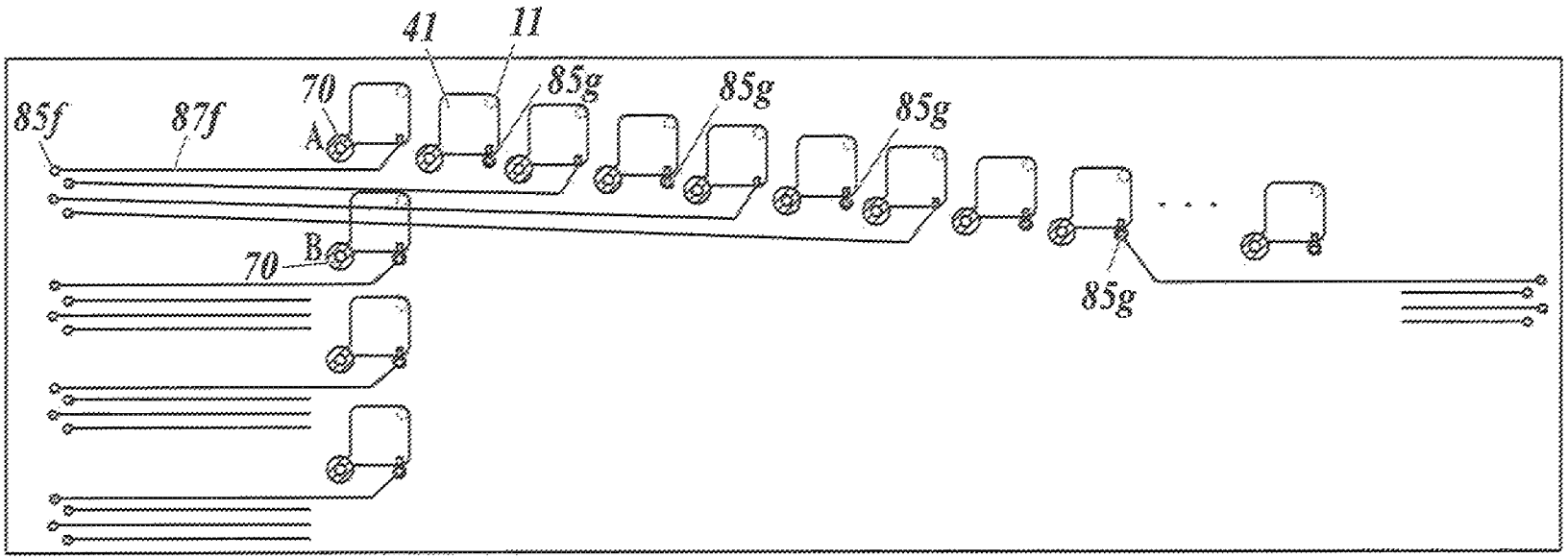
FIG. 8B shows the layout on the lower surface of the circuit board, i.e., shows the layout of the nozzles, pressure chambers, through hole vias, second wires, and connection members in the second embodiment.

Next, an inkjet printhead 3 of a second embodiment will be described. The second embodiment is different from the first embodiment in the layout of wires on a circuit board. Therefore, explanations are given only on the layout of wires below, and the explanations for the same parts as those of the first embodiment are omitted. Since FIG. 8A and FIG. 8B are drawn in landscape orientation due to limitations of space, the explanations below are given on the basis that FIG. 8A and FIG. 8B are seen from the right. That is, the left side of each of FIG. 8A and FIG. 8B is referred to as the upper side, the right side referred to as the lower side, the upper side referred to as the right side, and the lower side referred to as the left side when each of FIG. 5A and FIG. 8B is seen from the front.

As shown in FIG. 8A and FIG. 8B, among the through hole vias 85 corresponding to the nozzles 11 of the $1^{st}$ to $8^{th}$ rows, the through hole vias 85*f* corresponding to the nozzles 11 of the $1^{st}$, $3^{rd}$, $5^{th}$, and $7^{th}$ rows are provided outside of the two-dimensional-array area R on the far side of the $1^{st}$ nozzle row. More specifically, the through hole vias 85*f* corresponding to the nozzles 11 of the $1^{st}$, $3^{rd}$, $5^{th}$, and $7^{th}$ rows are provided on the far side of the first connection member 110 with the first connection member 110 disposed between each through hole via 85*f* and the two-dimensional-array area R on the circuit board 80.

The first wires 87*f* corresponding to the nozzles 11 of the $1^{st}$, $3^{rd}$, $5^{th}$, and $7^{th}$ rows are disposed on the lower surface of the circuit board 80. One end of each first wire 87*f* is connected to the corresponding piezoelectric element 60, and the other end thereof is connected to the lower end of the corresponding through hole via 85*f*.

The second wires 91*f* corresponding to the nozzles 11 of the $1^{st}$, $3^{rd}$, $5^{th}$ and $7^{th}$ rows are disposed over the upper surface of the circuit board 80. One end of each second wire 91*f* is connected to the upper end of the corresponding through hole via 85*f*, and the other end thereof is connected to the first connection member 110 through the far side of the first connection member 110 with respect to the two-dimensional-array area R.

More specifically, each of the wires of the $1^{st}$, $3^{rd}$, $5^{th}$, and $7^{th}$ nozzle rows is led from the corresponding piezoelectric element 60 toward the first connection member 110 (i.e., toward the $1^{st}$ nozzle row side) to the outside of the two-dimensional-array area R. Then, the wire is turned back at the corresponding through hole via 85*f* and is connected to the first connection member 110.

Each of the first wires 87*f* corresponding to the nozzles 11 of the $1^{st}$, $3^{rd}$, $5^{th}$, and $7^{th}$ rows in the $1^{st}$ line passes between the bonding member 70 corresponding to the nozzle 11 of the $1^{st}$ line and that of the $2^{nd}$ line (i.e., between A and B in FIG. 8B) and is connected to the first connection member 110. In the similar manner, each of the wires corresponding to the nozzles 11 of the $2^{nd}$ to $(M-1)^{th}$ lines passes between the corresponding bonding member 70 and the bonding member 70 immediately below, and is connected to the first connection member 110. The wires corresponding to the nozzles 11 of the $M^{th}$ line pass through an area below and adjacent to the $M^{th}$ line and are connected to the first connection member 110.

That is, the first wires 87*f* connected to the respective through hole vias 85*f* on the lower surface of the circuit board 80 are disposed outside the portion where the bonding member 70 is joined to the lower surface of the circuit board 80.

Among the through hole vias 85 corresponding to the nozzles 11 of the $1^{st}$ to $8^{th}$ rows, the through hole vias 85*g* corresponding to the nozzles 11 of the $2^{nd}$, $4^{th}$, $6^{th}$, and $8^{th}$ rows are provided inside of the two-dimensional-array area R. More specifically, each of the through hole vias 85*g* corresponding to the nozzles ii of the $2^{nd}$, $4^{th}$, $6^{th}$, and $8^{th}$ rows is disposed above the corresponding piezoelectric elements 60 on the circuit board 80.

As shown in FIG. 8A and FIG. 8B, the first wires (not shown) corresponding to the nozzles 11 of the $2^{nd}$, $4^{th}$, $6^{th}$, and $8^{th}$ rows are disposed on the lower surface of the circuit board 80. One end of each first wire is connected to the corresponding piezoelectric element 60, and the other end thereof is connected to the lower end of the corresponding through hole via 85*g*.

The second wires 91*g* corresponding to the nozzles 11 of the $2^{nd}$, $4^{th}$, $6^{th}$, and $8^{th}$ rows are disposed on the upper surface of the circuit board 80. One end of each second wire 91*g* is connected to the upper end of the corresponding through hole via 85*g*, and the other end thereof is connected to the first connection member 110.

More specifically, each of the wires of the $2^{nd}$, $4^{th}$, $6^{th}$, and $8^{th}$ nozzle rows is led from a through hole via 85*g* to the upper surface of the circuit board 80 above the corresponding piezoelectric element 60, and is led toward the first connection member 110 (i.e., toward the $1^{st}$ nozzle row side) to the outside of the two-dimensional-array area R. Thus, the wire is connected to the first connection member 110.

Each of the second wires 91*g* corresponding to the nozzles 11 of the $2^{nd}$, $4^{th}$, $6^{th}$, and $8^{th}$ rows in the $1^{st}$ line passes between the ink channel 88 corresponding to the nozzle 11 of the $1^{st}$ line and that of the $2^{nd}$ line (i.e., between A and B in FIG. 8A) and is connected to the first connection member 110. In the similar manner, each of the wires corresponding to the nozzles 11 of the $2^{nd}$ to $(M-1)^{th}$ lines passes between the corresponding ink channel 88 and the ink channel 88 immediately below, and is connected to the first connection member 110. The wires corresponding to the nozzles 11 of the $M^{th}$ line pass through an area below and adjacent to the $M^{th}$ line and are connected to the first connection member 110.

The wires corresponding to the nozzles 11 of the $9^{th}$ to $16^{th}$ rows are arranged similarly to those of the $1^{st}$ to $8^{th}$ rows. That is, each of the wires corresponding to the nozzles 11 of the $9^{th}$, $11^{th}$, $13^{th}$ and $15^{th}$ rows is connected to the second connection member 111 through the far side of the second connection member 111; and each of the wires corresponding to the nozzles 11 of the $10^{th}$, $12^{th}$, $14^{th}$, and $16^{th}$ rows is connected to the second connection member 111 through the inner side of the second connection member 111. The layout of through hole vias and wires is the same as that of the $1^{st}$ to $8^{th}$ rows, and the explanations for those are omitted.

[Third Embodiment]

Figure 9A:
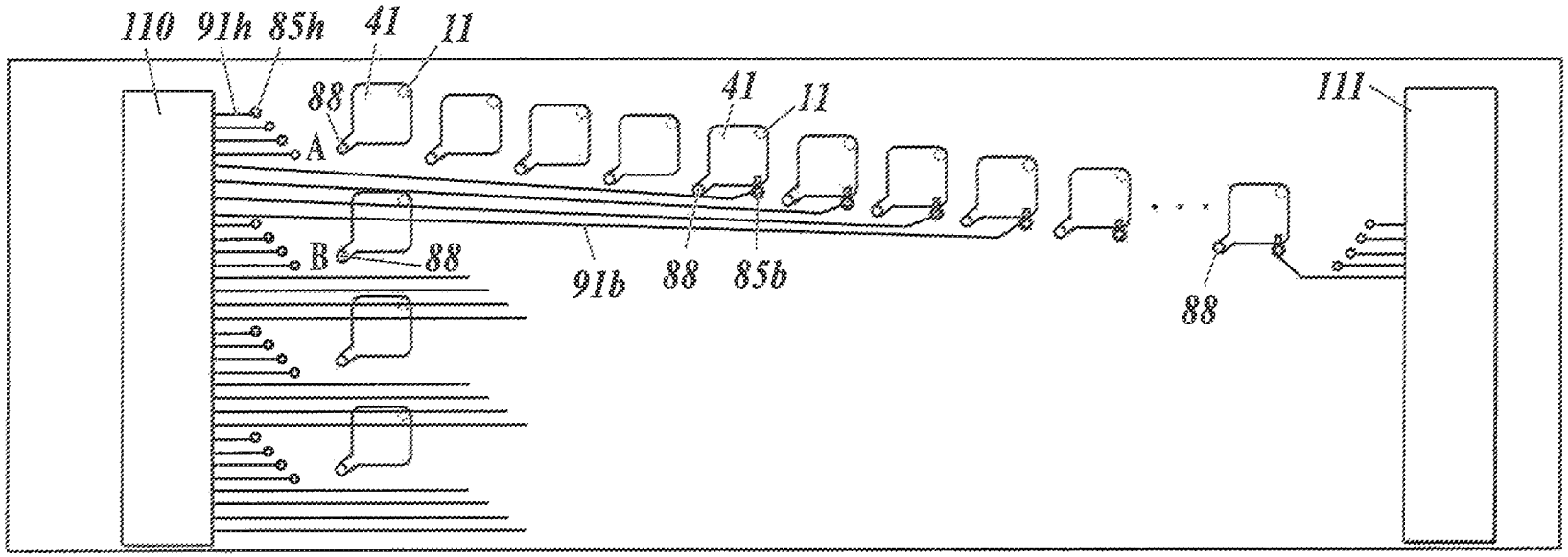
FIG. 9A shows the layout on the upper surface of a circuit board, i.e., shows the layout of nozzles, pressure chambers, through hole vias, second wires, and connection members in a third embodiment.
Figure 9B:
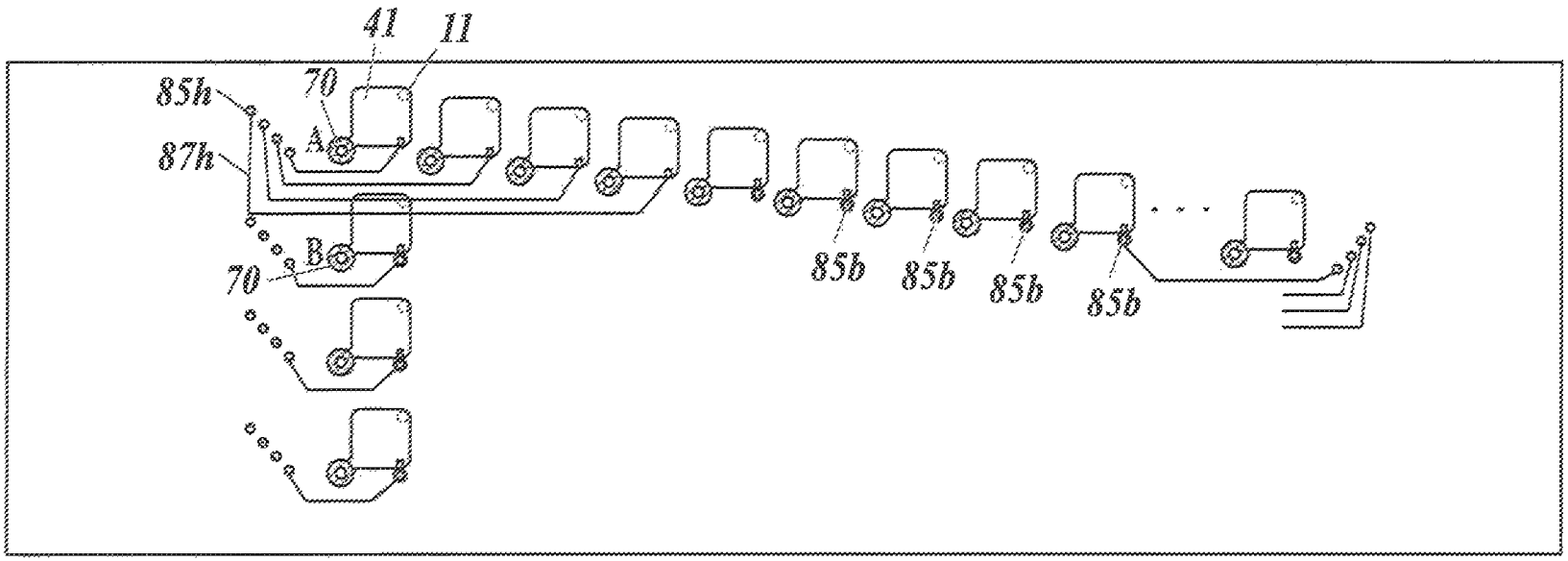
FIG. 9B shows the layout on the lower surface of the circuit board, i.e., shows the layout of the nozzles, pressure chambers, through hole vias, second wires, and connection members in the third embodiment.

Next, an inkjet printhead 3 of a third embodiment will be described. The third embodiment is different from the first embodiment in the layout of wires on a circuit board. Therefore, explanations are given only on the layout of wires below, and the explanations for the same parts as those of the first embodiment are omitted. Since FIG. 9A and FIG. 9B are drawn in landscape orientation due to limitations of space, the explanations below are given on the basis that FIG. 9A and FIG. 9B are seen from the right. That is, the left side of each of FIG. 9A and FIG. 9B is referred to as the upper side, the right side referred to as the lower side, the upper side referred to as the right side, and the lower side referred to as the left side when each of FIG. 9A and FIG. 9B is seen from the front.

As shown in FIG. 9A and FIG. 9B, among the through hole vias 85 corresponding to the nozzles 11 of the $1^{st}$ to $8^{th}$ rows, the through hole vias 85*h* corresponding to the nozzles 11 of the $1^{st}$ to $4^{th}$ rows are provided outside of the two-dimensional-array area R on the $1^{st}$ nozzle row side. More specifically, the through hole vias 85*h* corresponding to the nozzles 11 of the $1^{st}$ to $4^{th}$ rows are provided between the two-dimensional-array area R and the first connection member 110 on the circuit board 80. Such an arrangement of the through hole vias 85*h* means that no wires are disposed on the far side of the first connection member 110. This reduces the array area of wires, which leads to downsizing of an inkjet printhead.

The first wires 87*h* corresponding to the nozzles 11 of the $1^{st}$ to $4^{th}$ rows are disposed on the lower surface of the circuit board 80. One end of each first wire 87*h* is connected to the corresponding piezoelectric element 60, and the other end thereof is connected to the lower end of the corresponding through hole via 85*h*.

The second wires 91*h* corresponding to the nozzles 11 of the $1^{st}$ to $4^{th}$ rows are disposed over the upper surface of the circuit board 80. One end of each second wire 91*h* is connected to the upper end of the corresponding through hole via 85*h*, and the other end thereof is connected to the first connection member 110 through the near side of the first connection member 110 with respect to the two-dimensional-array area R.

More specifically, each of the wires of the $1^{st}$ to $4^{th}$ nozzle rows is led from the corresponding piezoelectric element 60 toward the first connection member 110 (i.e., toward the $1^{st}$ nozzle row side) to the outside of the two-dimensional-array area R at the lower surface of the circuit board 80. Then, the wire is led to the upper surface of the circuit board 80 at the corresponding through hole via 85*h* and is connected to the first connection member 110.

Each of the first wires 87*h* corresponding to the nozzles 11 of the $1^{st}$ to $4^{th}$ rows in the $1^{st}$ line passes between the bonding member 70 corresponding to the nozzle 11 of the $1^{st}$ line and that of the $2^{nd}$ line (i.e., between A and B in FIG. 9B) and is connected to the first connection member 110. In the similar manner, each of the wires corresponding to the nozzles 11 of the $2^{nd}$ to $(M-1)$ $1^{st}$ lines passes between the corresponding bonding member 70 and the bonding member 70 immediately below, and is connected to the first connection member 110. The wires corresponding to the nozzles 11 of the $M^{th}$ line pass through an area below and adjacent to the $M^{th}$ line and are connected to the first connection member 110.

That is, the first wires 87*h* connected to the respective through hole vias 85*h* on the lower surface of the circuit board 80 are disposed outside the portion where the bonding member 70 is joined to the lower surface of the circuit board 80.

Among the wires corresponding to the nozzles 11 of the $1^{st}$ to $8^{th}$ rows, the wires corresponding to the nozzles 11 of the $5^{th}$ to $8^{th}$ rows are the same as those of the first embodiment.

The explanations for the wires corresponding to the nozzles 11 of the $9^{th}$ to $16^{th}$ rows are omitted because they are arranged in the same manner as the $1^{st}$ to $8^{th}$ rows. That is, the wires corresponding to the $9^{th}$ to $12^{th}$ nozzle rows are arranged in the same manner as the wires corresponding to the $1^{st}$ to $4^{th}$ nozzle rows; and the wires corresponding to the $13^{th}$ to $16^{th}$ nozzle rows are arranged in the same manner as the wires corresponding to the $5^{th}$ to $8^{th}$ nozzle rows.

[Fourth Embodiment]

Figure 10A:
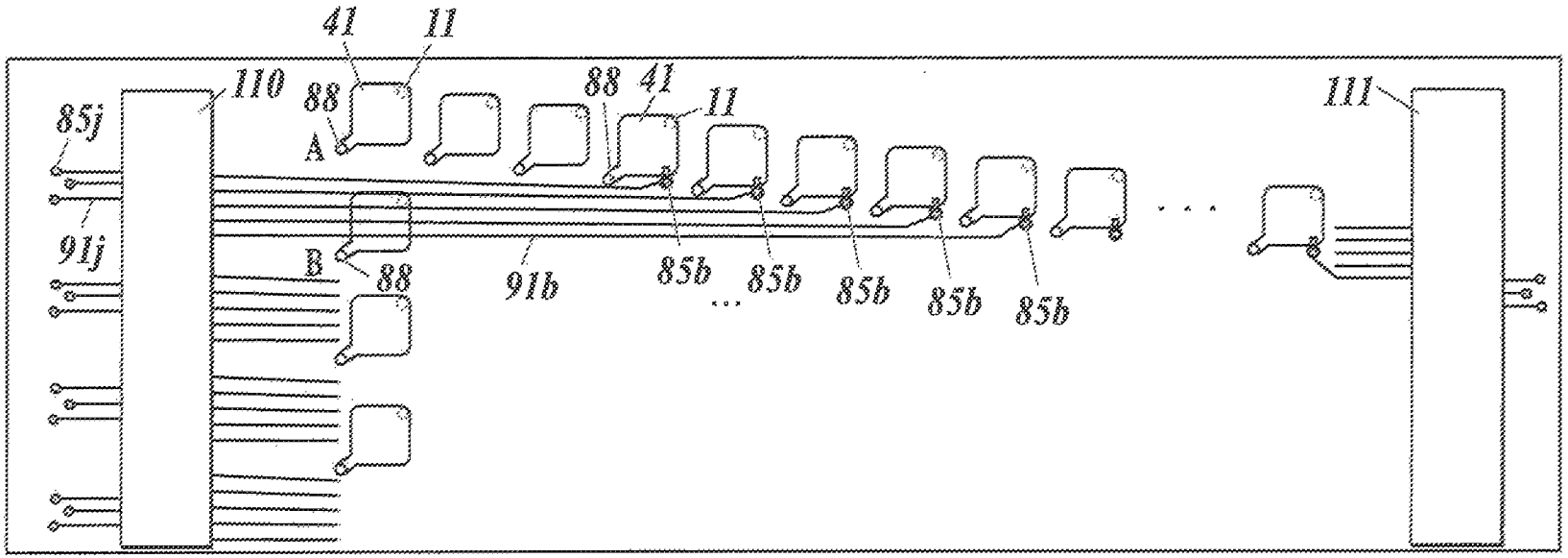
FIG. 10A shows the layout on the upper surface of a circuit board, i.e., shows the layout of nozzles, pressure chambers, through hole vias, second wires, and connection members in a fourth embodiment.
Figure 10B:
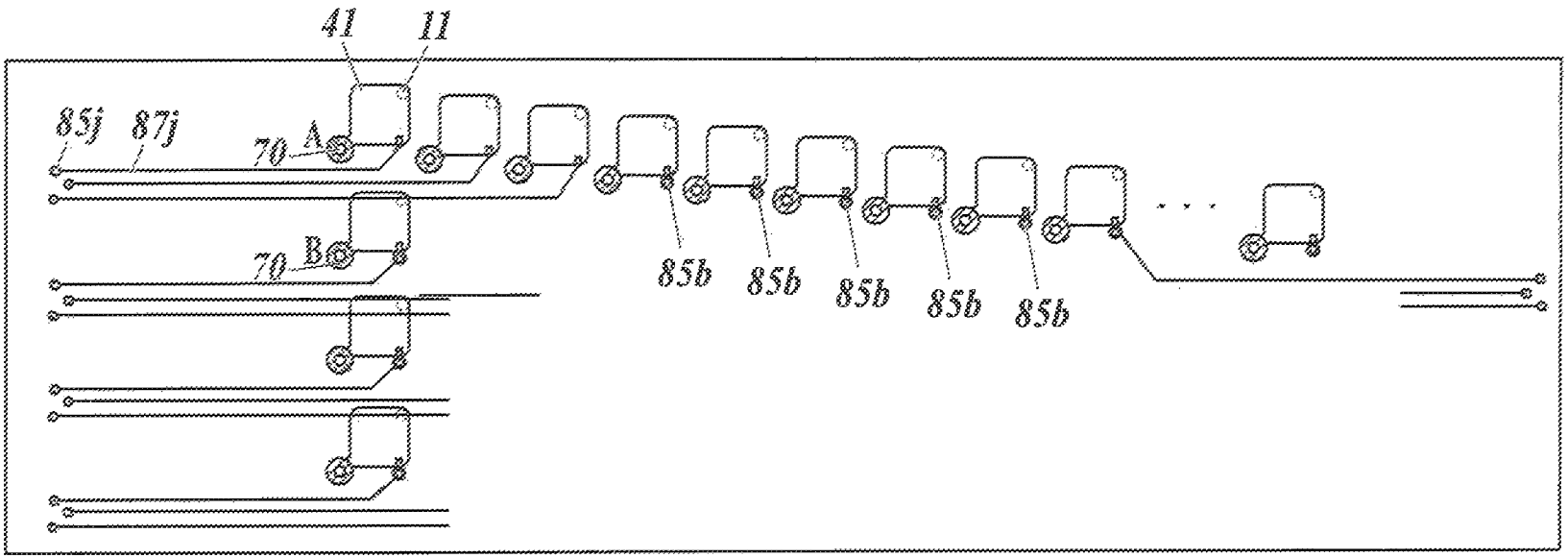
FIG. 10B shows the layout on the lower surface of the circuit board, i.e., shows the layout of the nozzles, pressure chambers, through hole vias, second wires, and connection members in the fourth embodiment.

Next, an inkjet printhead 3 of a fourth embodiment will be described. The fourth embodiment is different from the first embodiment in the layout of wires on a circuit board. Therefore, explanations are given only on the layout of wires below, and the explanations for the same parts as those of the first embodiment are omitted. Since FIG. 10A and FIG. 10B are drawn in landscape orientation due to limitations of space, the explanations below are given on the basis that FIG. 10A and FIG. 10B are seen from the right. That is, the left side of each of FIG. 10A and FIG. 10B is referred to as the upper side, the right side referred to as the lower side, the upper side referred to as the right side, and the lower side referred to as the left side when each of FIG. 10A and FIG. 10B is seen from the front.

As shown in FIG. 10A and FIG. 10B, among the through hole vias 85 corresponding to the nozzles 11 of the $1^{st}$ to $8^{th}$ rows, the through hole vias 85*j* corresponding to the nozzles 11 of the $1^{st}$ to $3^{rd}$ rows are provided outside of the two-dimensional-array area R on the $1^{st}$ nozzle row side. More specifically, the through hole vias 85*j* corresponding to the nozzles 11 of the $1^{st}$ to $3^{rd}$ rows are provided on the far side of the first connection member 110 with the first connection member 110 disposed between each through hole via 85*j* and the two-dimensional-array area R on the circuit board 80.

The first wires 87*j* corresponding to the nozzles 11 of the $1^{st}$ to $3^{rd}$ rows are disposed on the lower surface of the circuit board 80. One end of each first wire 87*j* is connected to the corresponding piezoelectric element 60, and the other end thereof is connected to the lower end of the corresponding through hole via 85*j*.

The second wires 91*j* corresponding to the nozzles 11 of the $1^{st}$ to $3^{rd}$ rows are disposed over the upper surface of the circuit board 80. One end of each second wire 91*j* is connected to the upper end of the corresponding through hole via 85*j*, and the other end thereof is connected to the first connection member 110 through the far side of the first connection member 110 with respect to the two-dimensional-array area R.

More specifically, each of the wires of the $1^{st}$ to $3^{rd}$ nozzle rows is led from the corresponding piezoelectric element 60 toward the first connection member 110 (i.e., toward the $1^{st}$ nozzle row side) to the outside of the two-dimensional-array area R at the lower surface of the circuit board 80. Then, the wire is led to the upper surface of the circuit board 80 at the through hole via 85*j* and is connected to the first connection member 110.

Each of the first wires 87*j* corresponding to the nozzles 11 of the $1^{st}$ to $3^{rd}$ rows in the $1^{st}$ line passes between the bonding member 70 corresponding to the nozzle 11 of the $1^{st}$ line and that of the $2^{nd}$ line (i.e., between A and B in FIG. 10B) and is connected to the first connection member 110. In the similar manner, each of the wires corresponding to the nozzles 11 of the $2^{nd}$ to $(M-1)^{th}$ lines passes between the corresponding bonding member 70 and the bonding member 70 immediately below, and is connected to the first connection member 110. The wires corresponding to the nozzles 11 of the $M^{th}$ line pass through an area below and adjacent to the $M^{th}$ line and are connected to the first connection member 110.

That is, the first wires 87*j* connected to the respective through hole vias 85*j* on the lower surface of the circuit board 80 are disposed outside the portion where the bonding member 70 is joined to the lower surface of the circuit board 80.

Among the wires corresponding to the nozzles 11 of the $1^{st}$ to $8^{th}$ rows, the wires corresponding to the nozzles 11 of the $4^{th}$ to $8^{th}$ rows are the same as those of the nozzles 11 of the $5^{th}$ to $8^{th}$ rows in the first embodiment.

The explanations for the wires corresponding to the nozzles 11 of the $9^{th}$ to $16^{th}$ rows are omitted because they are arranged in the same manner as the $1^{st}$ to $8^{th}$ rows. That is, the wires corresponding to the $9^{th}$ to $11^{th}$ nozzle rows are arranged in the same manner as the wires corresponding to the $1^{st}$ to $3^{rd}$ nozzle rows; and the wires corresponding to the $12^{th}$ to $16^{th}$ nozzle rows are arranged in the same manner as the wires corresponding to the $4^{th}$ to $8^{th}$ nozzle rows.

<Effects>

As described above, according to the present embodiments, some of the through hole vias 85 corresponding to the nozzles 11 are disposed inside of the two-dimensional-array area R, and the other of the through hole vias 85 are disposed outside of the two-dimensional-array area R. Therefore, not all the wires 87 and 91 connected to the through hole vias 85 have to run between adjacent ink channels 88. In the present embodiments, when the wires are divided into equal halves and half of the wires are connected to the right connection member and the other half are connected to the left connection member, the number of wires disposed on each of the upper and lower surfaces of the circuit board 80 is only N/4 at the maximum.

This greatly reduces the number of wires 87 and 91 disposed between adjacent ink channels 88 corresponding to the nozzles 11 of the $1^{st}$ and $16^{th}$ rows where the density of wires 87 and 91 is the highest. Accordingly, the width of each wire and the space between wires can be made larger. This achieves densely-arranged nozzles 11 and enhances the reliability of the wires 87 and 91.

Further, since the wires 87 and 91 are concentrated in one surface of the circuit board 80 through the through hole vias 85, the connection members 110 and 111 need to be formed on only one surface of the circuit board 80. Accordingly, there is no need to make the circuit board 80 multilayered, and no need to provide connection members 110 and 111 on both surfaces of the circuit board 80. This achieves more effective use of space on the circuit board 80 with a simple structure and achieves cost reduction.

Further, all the wires 87 and 91 are divided into two bundles of wires: the wires of one bundle are led toward the $1^{st}$ row side, and the wires of the other bundle are led toward the $16^{th}$ row side. This reduces the number of wires 87 and 91 disposed between adjacent ink channels 88 corresponding to the nozzles 11 of the $1^{st}$ and $16^{th}$ rows where the density of wires 87 and 91 is the highest. Accordingly, the width of each wire and the space between wires can be made larger.

Further, each of the two bundles of wires running in different directions is further divided into two bundle of wires: the wires of one bundle are connected to the respective through hole vias inside of the two-dimensional-array area R, and the wires of the other bundle are connected to the respective through hole vias outside of the two-dimensional-array area R. This further reduces the number of wires 87 and 91 disposed between adjacent ink channels 88 corresponding to the nozzles 11 of the $1^{st}$ and $16^{th}$ rows. Accordingly, the width of each wire and the space between wires can be made still larger.

Further, the through hole vias provided outside of the two-dimensional-array area R are divided and disposed on the far side the $1^{st}$ row and $16^{th}$ row, i.e., disposed in the opposite directions with respect to the two-dimensional-array area R. This can achieve effective use of space for wires, and allows the width of each wire and the space between wires larger.

Further, the wires led toward the $1^{st}$ row are connected to the first connection member 110 on the $1^{st}$ row side, and the wires led toward the $16^{th}$ row are connected to the second connection member 111 on the $16^{th}$ row side. This structure can shorten the distance between each through hole via 85 and the connection members 110 or 111 to be connected, which allows the wires to be shorter.

Further, each of the connection members 110 and 111 is disposed between the two-dimensional-array area R and the through hole vias. Accordingly, the wires 91 are connected to the connection members 110 from both sides thereof, and connected to the connection members 111 from both sides thereof. This allows the width of each wire and the space between wires around each of the connection members 110 and 111 to be larger, resulting in effective use of space for wires.

Further, since the number of through hole vias 85 disposed inside of the two-dimensional-array area R is the same as the number of through hole vias 85 disposed outside of the two-dimensional-array area R, the number of wires disposed on the lower surface of the circuit board 80 is the same as that on the upper surface of the circuit board 80. Accordingly, there is not a large difference in the width of each wire and in the space between wires between two surfaces of the circuit board 80. This allows the width of each wire and the space between wires to be larger, resulting in effective use of space for wires.

The wires connected to the respective through hole vias outside of the two-dimensional-array area R are disposed outside the portion where the bonding member 70 is joined to the circuit board 80. This prevents deterioration of joint strength between the bonding member 70 and the circuit board 80.

As illustrated in the fourth embodiment, a bonding member 70 having an ink channel 72 to supply ink to a pressure chamber 41 is provided on one surfaces of the circuit board 80, which surface is closer to the piezoelectric elements 60 than the other surface (i.e., on the lower surface of the circuit board 80). Each wire 87, therefore, has to be disposed avoiding the bonding member 70. Accordingly, the space for wires on this surface is smaller than the other surface.

On the surface on which the bonding member 70 is provided, the wires 87*j*, which are connected to the respective through hole vias 85*j* disposed outside of the two-dimensional-array area R, are provided. In view of this, the number of wires on the surface on which the bonding member 70 is provided may be smaller than the number of wires connected to the respective through hole vias 85*b* disposed inside of the two-dimensional-array area R.

Since the bonding member 70 makes the space for wires on the lower surface of the circuit board 80 smaller, it is preferable that (N/4)+n wires be provided on the upper surface of the circuit board 80; and (N/4)−n wires be provided on the lower surface of the circuit board 80. This advantageously achieves more effective use of space for wires than in the case where the upper and lower surfaces of the circuit board 80 have the same number of wires.

In other words, the width of each wire and the space between wires are well-balanced between both surfaces of the circuit board 80.

Figure 11:
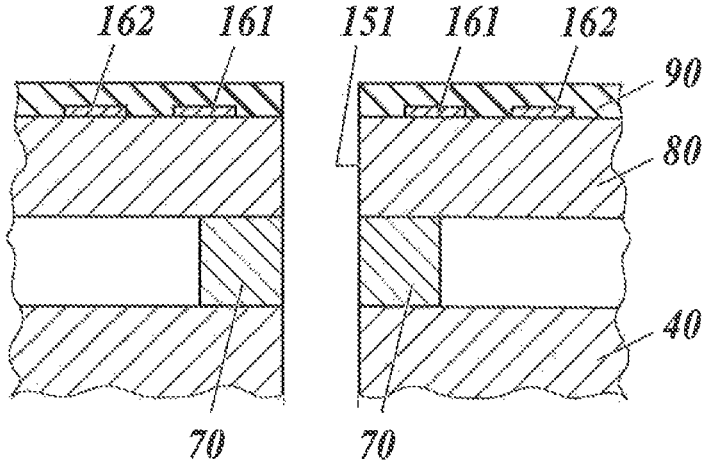
FIG. 11 illustrates wires adjacent to an ink channel.
Figure 13A:
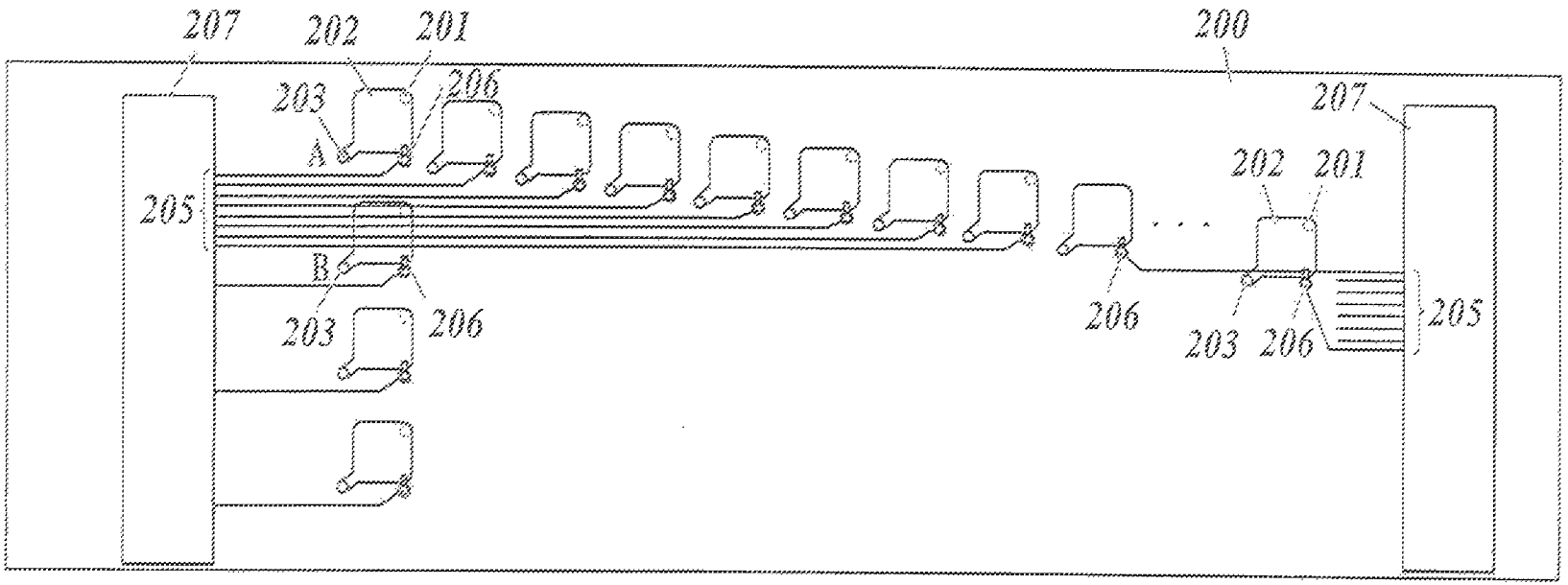
FIG 13A PRIOR ART
FIG. 13A shows a circuit board of a conventional inkjet printhead viewed, from above.
Figure 13B:
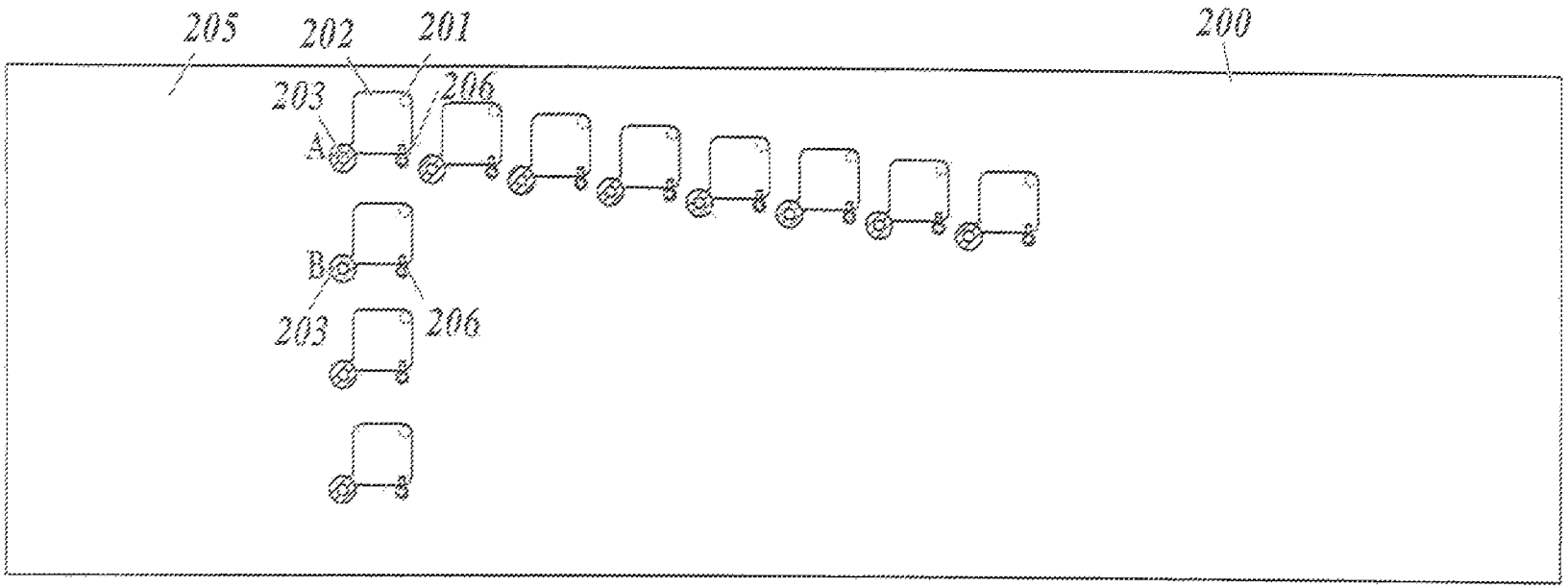
FIG 13B PRIOR ART
FIG. 13B is a view of the lower surface, viewed from above, of a circuit board of a conventional inkjet printhead supposing that the lower surface can be seen through from above.
Figure 14:
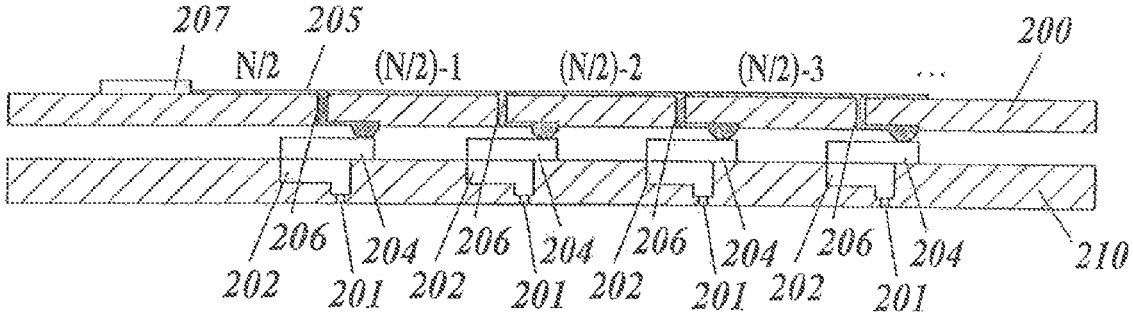
FIG.14 PRIOR ART
FIG. 14 is a cross-sectional view of a circuit board and its surroundings of a conventional inkjet printhead.

Further, since the space allowed for each wire can be made larger as described above, the space between a wire 161 adjacent to an ink channel 151 and the adjacent ink channel 151 can be made larger than the space between wires (i.e., the space between the wires 161 and 162), as shown in FIG. 11, for example.

Disposing the wire 161 adjacent to the ink channel 151 far apart from the ink channel 151 in this way, the wire 161 is less likely to be exposed to the outside even when the protective layer 90 provided on the upper surface of the circuit board 80 is partially removed, or when the corners are rounded off. This can prevent a bad conduction of the wire 161.

Therefore, when the line/space (L/S) can be flexible, it is preferable that the space between a wire adjacent to an ink channel and the ink channel be preferentially made larger.

<Comparison with Conventional Wire Layout>

A comparison with conventional wire layouts will be made below.

FIG. 12 shows a table comparing spaces allowed for one wire by varying a nozzle density, the number of nozzle rows, and the layout of wires.

As shown in the top row of FIG. 12, calculations were performed on the basis that the nozzle density is 600 npi, the number of nozzle rows N is 16, the space between nozzles is 677 μm, the inside diameter of ink channel is 100 μm, and that the outside diameter of ink channel is 200 μm. Space allowed for one wire was calculated for the following four wiring patterns: a pattern where all of 16 wires are disposed between adjacent ink channels of the $1^{st}$ nozzle row (pattern A in FIG. 12); a pattern where 8 of the 16 wires are disposed between adjacent ink channels of the $1^{st}$ nozzle row, and the other 8 wires are disposed between adjacent ink channels of the $16^{th}$ nozzle row (pattern B in FIG. 12); a pattern where 8 of the 16 wires are disposed between adjacent ink channels of the $1^{st}$ nozzle row and the other 8 wires are disposed between adjacent ink channels of the $16^{th}$ nozzle row, and 4 of the 8 wires are disposed on the upper surface of the circuit board and the other 4 wires are disposed on the lower surface of the circuit board for each bundle of 8 wires (pattern C in FIG. 12: corresponding to the first to third embodiments); and a pattern where 8 of the 16 wires are disposed between adjacent ink channels of the $1^{st}$ nozzle row and the other 8 wires are disposed between adjacent ink channels of the $16^{th}$ nozzle row, and 5 of the 8 wires are disposed on the upper surface of the circuit board and the other 3 wires are disposed on the lower surface of the circuit board for each bundle of 8 wires (pattern D in FIG. 12: corresponding to the fourth embodiment).

In the wiring pattern A, the space allowed for one wire is 36.1 μm and the line/space (L/S) is 18/18.

In the wiring pattern B, the space allowed for one wire is 72.2 μm and the line/space (L/S) is 36/36.

In the wiring pattern C, the space allowed for one wire on the upper surface of the circuit board is 144.3 μm, and that on the lower surface is 119.3 μm; and the line/space (L/S) for the upper surface is 72/72, and that for the lower surface is 59/59.

In the wiring pattern D, the space allowed for one wire on the upper surface of the circuit board is 115.5 μm, and that on the lower surface is 159.1 μm; and the line/space (L/S) for the upper surface is 57/57, and that for the lower surface is 79/79.

The spaces allowed for one wire calculated under various nozzle densities and numbers of nozzle rows are shown in FIG. 12. It is found that, in any condition, the wiring patterns of the present embodiments can allow larger space for one wire than a conventional wiring pattern.

In this way, reduction in the number of wires running between adjacent ink channels can enhance the reliability of the wires.

In the case of the pattern D with 32 nozzle rows in FIG. 12, the calculations are performed on the basis that 16 of the 32 wires are disposed between adjacent ink channels of the $1^{st}$ nozzle row and the other 16 wires are disposed between adjacent ink channels of the $32^{nd}$ nozzle row, and 10 of the 16 wires are disposed on the upper surface of the circuit board and the other 6 wires are disposed on the lower surface of the circuit board for each bundle of 16 wires.

In the same manner, in the case of the pattern D with 8 nozzle rows in FIG. 12, the calculations are performed on the basis that 4 of the 8 wires are disposed between adjacent ink channels of the $1^{st}$ nozzle row and the other 4 wires are disposed between adjacent ink channels of the $8^{th}$ nozzle row, and 3 of the 4 wires are disposed on the upper surface of the circuit board and the other 1 wire is disposed on the lower surface of the circuit board for each bundle of 4 wires.

<Other Variations>

The present invention is not limited to the above-described embodiments but may be changed in design in any way without departing from the spirit of the invention.

For example, while the present embodiments include two connection members, three or more connection members may be included and the wires may be divided into three or more bundles according to the number of the connection members.

Further, while the layout of the wires corresponding to the nozzle rows on the left side connected to the first connection member is the same as those of the right side connected to the second connection member in the present embodiments, the layouts of the left side and the right side do not have to be the same. That is, the number of wires led to the outside of the two-dimensional-array area may be different between the right-side nozzle rows and the left-side nozzle rows.

Industrial Applicability

As described above, the inkjet printhead according to the present invention is useful for forming a high-definition image with densely-arranged nozzles.

Reference Numerals

3 inkjet printhead
11 nozzle
41 pressure chamber
60 piezoelectric element (actuator)
70 bonding member
72 ink channel (communicating channel.)
80 circuit board
85 through hole via
87 first wire (wire)
88 ink channel
91 second wire (wire)
110 first connection member (connection member)
111 second connection member (connection member)
R two-dimensional-array area (array area)

The invention claimed is:

1. An inkjet printhead comprising;

a plurality of sets each of which includes a nozzle to eject ink, a pressure chamber communicating with the nozzle, and an actuator to apply force to elect the ink in the pressure chamber through the nozzle, wherein the sets are two-dimensionally arrayed;

a circuit board including:

plurality of wires each connected to the actuator of each set;

plurality of through hole vias each connected to a corresponding wire; and ink channels each supplying the ink to the pressure chamber of each set; and a connection member to connect the wires to a driving unit, the connection member being provided outside of an array area, the array area being an area where all of the sets of the inkjet printhead are two-dimensionally arrayed, wherein the nozzles are arranged linearly to form nozzle rows, and the number of the nozzles in each of the nozzle rows is M, wherein M is an integer of 2 or more;

wherein the number of the nozzle rows is N, wherein N is an integer of 2 or more;

wherein the through hole via corresponding to each of the nozzles of n nozzle row of the N nozzle rows is provided inside of the array area, wherein n is any integer satisfying $1 \leq n < N$; and wherein the through hole via corresponding to each of the nozzles of the N nozzle rows except the a nozzle row is provided outside of the array area, and wherein the connection member is disposed between the through hole via corresponding to each of the nozzles of n nozzle row of the N nozzle rows and the through hole via corresponding to each of the nozzles of the N nozzle rows except the n nozzle row.

2. The inkjet printhead according to claim 1, wherein N is an even number of 2 or more;

wherein the wire connected to the through hole via corresponding to each of the nozzles of the $1^{st}$ to $(N/2)^{th}$ nozzle rows is led to the outside of the array area on a $1^{st}$ nozzle row side;

wherein the wire connected to the through hole via corresponding to each of the nozzles of the $(N/2)+1^{th}$ to $N^{th}$ nozzle rows is led to the outside of the array area on a $N^{th}$ nozzle row side;

wherein among the nozzles of the $1^{st}$ to $(N/2)^{th}$ nozzle rows, the through hole via corresponding to each of the nozzles of $\alpha$ nozzle rows is provided outside of the array area, wherein $\alpha$ is any integer satisfying $1 \leq \alpha < N/2$; and wherein among the nozzles of the $(N/2)+1^{th}$ to $N^{th}$ nozzle rows, the through hole via corresponding to each of the nozzles of $\beta$ nozzle rows is provided. outside of the array area, wherein $\beta$ is any integer satisfying $1\beta < N/2$.

3. The inkjet printhead according to claim 2, wherein the through hole via corresponding to each of the nozzles of the $\alpha$ nozzle rows is provided outside of the array area on the $1^{st}$ nozzle row side; and wherein the through hole via corresponding to each of the nozzles of the $\beta$ nozzle rows is provided outside of the array area on the $N^{th}$ nozzle row side.

4. The inkjet printhead according to claim 2, wherein the connection member includes a first connection member and a second connection member, the first. connection member being provided outside of the array area on the $1^{st}$ nozzle row side on one surface of the circuit board, the second connection member being provided outside of the array area on the $N^{th}$ nozzle row side on the one surface of the circuit board;

wherein the wire connected to the through hole via corresponding to each of the nozzles of the $1^{st}$ to $(N/2)^{th}$ nozzle rows is connected to the first connection member; and wherein the wire connected to the through hole via, corresponding to each of the nozzles of the $(N/2)+1^{th}$ to $N^{th}$ nozzle rows is connected to the second connection member.

5. The inkjet printhead according to claim 4, wherein the through hole via corresponding to each of the nozzles of the $\alpha$ nozzle rows is provided on a far side of the first connection member with the first connection, member disposed between the array area and the through hole via corresponding to each of the nozzles of the $\alpha$ nozzle rows; and wherein the through hole via corresponding each of to the nozzles of the $\beta$ nozzle rows is provided on a far side of the second connection member with the second connection member disposed between the array area and the through hole via corresponding to each of the nozzles of the β nozzle rows.

6. The inkjet printhead according to claim 1, wherein the number of the through hole via provided inside of the array area is the same as the number of the through hole via provided outside of the array area.

7. The inkjet printhead according to claim 1, wherein the number of the through hole via provided inside of the array area is larger than the number of the through hole via provided outside of the array area.

8. The inkjet printhead according to claim 1, further comprising:

a bonding member having a communicating channel that allows the ink channel, to communicate with the pressure chamber, the bonding member being provided on a surface of the circuit board, the surface being opposite to a surface on which the connection member is provided, wherein the wire connected to the through hole via outside of the array area is disposed outside a portion where the bonding member is joined to the circuit board.

* * * * *